US009646567B2

(12) United States Patent
Nakanishi et al.

(10) Patent No.: US 9,646,567 B2
(45) Date of Patent: May 9, 2017

(54) DISPLAY DEVICE, ELECTRONIC APPARATUS, AND COLOR CONVERSION METHOD

(71) Applicant: Japan Display Inc., Tokyo (JP)

(72) Inventors: Takayuki Nakanishi, Tokyo (JP); Tatsuya Yata, Tokyo (JP); Hirokazu Tatsuno, Tokyo (JP); Kiyoshi Nakamura, Tokyo (JP)

(73) Assignee: Japan Display Inc., Tokyo (JP)

( * ) Notice: Subject to any disclaimer, the term of this patent is extended or adjusted under 35 U.S.C. 154(b) by 33 days.

(21) Appl. No.: 14/947,610

(22) Filed: Nov. 20, 2015

(65) Prior Publication Data

US 2016/0148583 A1 May 26, 2016

(30) Foreign Application Priority Data

Nov. 26, 2014 (JP) ..... 2014-238678

(51) Int. Cl.

| | |
|---|---|
| ***G09G 3/34*** | (2006.01) |
| ***G09G 5/04*** | (2006.01) |
| ***G09G 3/3225*** | (2016.01) |

(52) U.S. Cl.

CPC ..... *G09G 5/04* (2013.01); *G09G 3/3225* (2013.01); *G09G 2300/0452* (2013.01); *G09G 2320/0666* (2013.01); *G09G 2320/08* (2013.01); *G09G 2330/021* (2013.01); *G09G 2340/06* (2013.01); *G09G 2360/144* (2013.01); *G09G 2380/10* (2013.01)

(58) Field of Classification Search

None

See application file for complete search history.

(56) References Cited

U.S. PATENT DOCUMENTS

| | | | | |
|---|---|---|---|---|
| 7,277,075 | B1 | 10/2007 | Hirano et al. | |
| 2005/0099426 | A1 | 5/2005 | Primerano et al. | |
| 2012/0050345 | A1* | 3/2012 | Higashi ..... | G09G 3/3426 345/690 |
| 2012/0268354 | A1 | 10/2012 | Mizukoshi et al. | |
| 2015/0109319 | A1 | 4/2015 | Yata et al. | |
| 2015/0109320 | A1 | 4/2015 | Yata et al. | |
| 2015/0109325 | A1 | 4/2015 | Yata et al. | |

(Continued)

FOREIGN PATENT DOCUMENTS

| | | | |
|---|---|---|---|
| JP | 3167026 | B2 | 3/2001 |
| JP | 2006-3475 | A | 1/2006 |
| JP | 3805150 | B2 | 5/2006 |

(Continued)

*Primary Examiner* — Joseph Haley

(74) *Attorney, Agent, or Firm* — Michael Best & Friedrich LLP

(57) ABSTRACT

According to an aspect, a display device includes an image display unit in which pixels each including a plurality of sub-pixels are arranged in a matrix, and a color converting unit that performs color conversion to reduce power consumption in the image display unit. The color converting unit does not perform the color conversion when total power consumption obtained by adding up the power consumption in the image display unit and power consumption in the color converting unit in a case where the color conversion is performed exceeds the power consumption in the image display unit in a case where the color conversion is not performed.

9 Claims, 17 Drawing Sheets

(56) References Cited

U.S. PATENT DOCUMENTS

2015/0161935 A1* 6/2015 Giannikouris ..... G09G 3/2003
345/694

FOREIGN PATENT DOCUMENTS

| | | | |
|---|---|---|---|
| JP | 2007-514184 | A | 5/2007 |
| JP | 2011-90118 | A | 5/2011 |
| JP | 4870358 | B2 | 11/2011 |

* cited by examiner

DISPLAY DEVICE, ELECTRONIC APPARATUS, AND COLOR CONVERSION METHOD

CROSS-REFERENCE TO RELATED APPLICATIONS

This application claims priority from Japanese Application No. 2014-238678, filed on Nov. 26, 2014, the contents of which are incorporated by reference herein in its entirety.

BACKGROUND

1. Technical Field

The present invention relates to a display device, an electronic apparatus, and a color conversion method.

2. Description of the Related Art

Conventionally widely used are liquid-crystal display devices provided with an RGBW liquid-crystal panel including pixels white (W) besides pixels red (R), green (G), and blue (B). RGBW liquid-crystal display devices display an image by allocating light transmitted through the pixels R, G, and B from a backlight based on RGB data that determines image display to the pixels W. Thus, the RGBW liquid-crystal display devices can reduce the luminance of the backlight, thereby reducing power consumption.

Besides the liquid-crystal display devices, widely known are image display panels that cause their light emitters, such as an organic light-emitting diode (OLED), to light up. Japanese Translation of PCT International Application No. 2007-514184 (JP-T-2007-514184), for example, describes a method for transforming three color input signals (R, G, B) corresponding to three gamut defining primary colors into four color output signals (R', G', B', W) corresponding to the gamut defining primary colors and an additional primary color W to drive a display device including light emitters that emit light corresponding to the four color output signals.

A display device including an image display unit that causes its light emitters to light up requires no backlight. The amount of power for the display device is determined depending on the amount of lighting of the light emitters in respective pixels. In a case where transformation process is performed simply by carrying out the method described in JP-T-2007-514184, power consumption may possibly fail to be reduced because of a large amount of lighting of the light emitters that output the four color output signals (R', G', B', W).

The power consumption in the image display unit may be reduced by performing color conversion for converting the hue and/or the saturation of an original color within a range where humans hardly notice a change, for example. When a user darkens a screen (lowers the luminance setting) to use a display device and/or an electronic apparatus indoors, however, the power consumption caused by the color conversion may possibly be considerably large with respect to the power consumption in the image display unit. As a result, the power consumption in the entire display device or the entire electronic apparatus may possibly be larger than that in a case where no color conversion is performed.

For the foregoing reasons, there is a need for a display device, an electronic apparatus, and a color conversion method capable of reducing the power consumption in a low-luminance state with a configuration that performs color conversion to reduce the power consumption in the image display unit.

SUMMARY

According to an aspect, a display device includes an image display unit in which pixels are arranged in a matrix, each of the pixels including a plurality of sub-pixels; and a color converting unit that performs color conversion to reduce power consumption in the image display unit. The color converting unit does not perform the color conversion when total power consumption obtained by adding up the power consumption in the image display unit and power consumption in the color converting unit in a case where the color conversion is performed exceeds the power consumption in the image display unit in a case where the color conversion is not performed.

DETAILED DESCRIPTION

Figure 1:
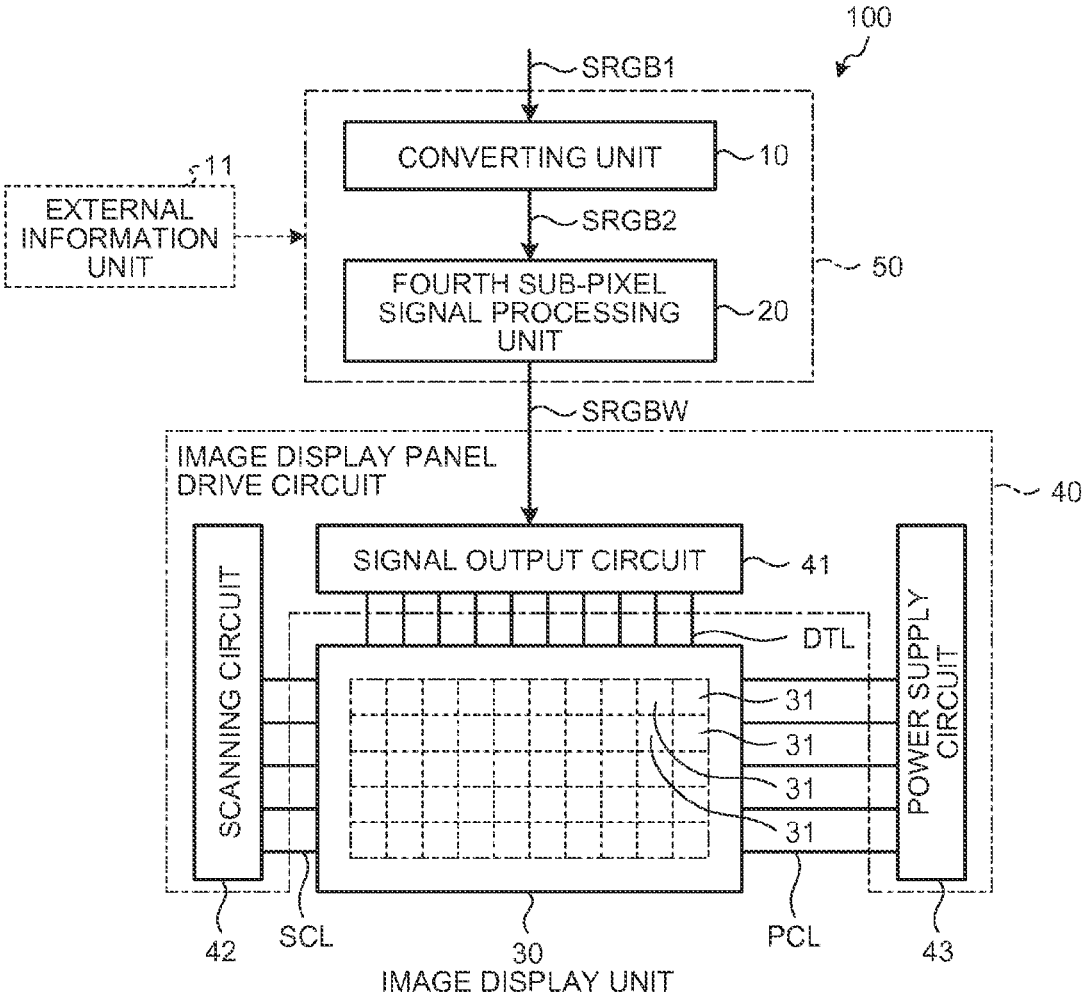
FIG. 1 is a block diagram of an exemplary configuration of a display device according to an embodiment.

Exemplary aspects (embodiments) according to the present invention are described below in greater detail with reference to the accompanying drawings. The contents described in the embodiments are not intended to limit the present invention. Components described below include components easily conceivable by those skilled in the art and components substantially identical therewith. The components described below may be appropriately combined. The disclosure is given by way of example only. Various changes and modifications made without departing from the spirit of the invention and easily conceivable by those skilled in the art are naturally included in the scope of the invention. To simplify the explanation, the drawings may possibly illustrate the width, the thickness, the shape, and other elements of each unit more schematically than the actual aspect. These elements, however, are given by way of example only and are not intended to limit interpretation of the invention. In the specification and the figures, components similar to those previously described with reference to a preceding figure are denoted by like reference numerals, and overlapping explanation thereof will be appropriately omitted.

First Embodiment

Configuration of the Display Device

Figure 2:
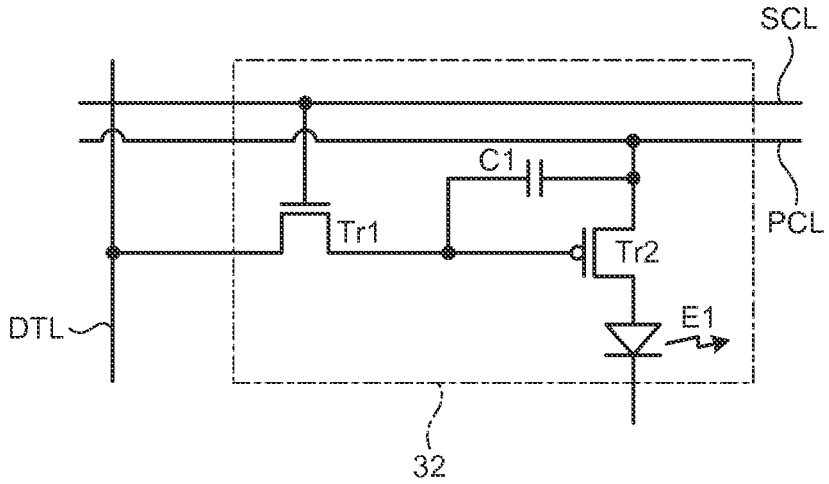
FIG. 2 is a diagram of a lighting drive circuit of a sub-pixel included in a pixel of an image display unit according to the embodiment.
Figure 3:
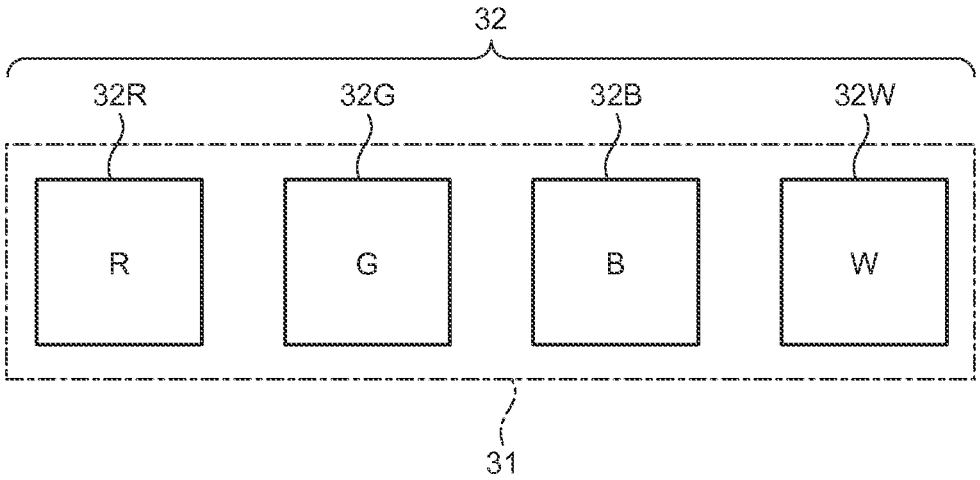
FIG. 3 is a diagram of an array of sub-pixels in the image display unit according to the embodiment.
Figure 4:
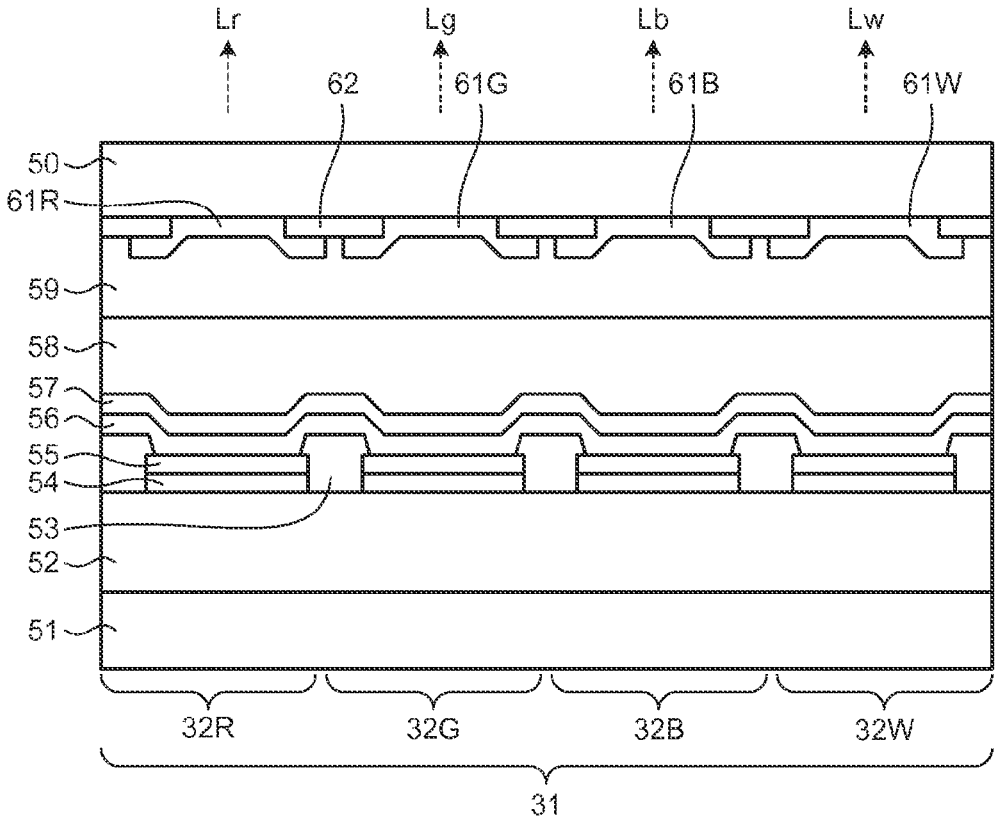
FIG. 4 is a schematic view of a sectional structure of the image display unit according to the embodiment.

FIG. 1 is a block diagram of an exemplary configuration of a display device according to an embodiment. FIG. 2 is a diagram of a lighting drive circuit of a sub-pixel included in a pixel of an image display unit according to the embodiment. FIG. 3 is a diagram of an array of sub-pixels in the image display unit according to the embodiment. FIG. 4 is a schematic view of a sectional structure of the image display unit according to the embodiment.

As illustrated in FIG. 1, a display device 100 includes a converting unit 10, a fourth sub-pixel signal processing unit 20, an image display unit 30 serving as an image display panel, and an image display panel drive circuit 40 (hereinafter, also referred to as a drive circuit 40) that controls drive of the image display unit 30. The functions of the converting unit 10 and the fourth sub-pixel signal processing unit 20 may be provided by hardware or software and are not limited. In a case where respective circuits of the converting unit 10 and the fourth sub-pixel signal processing unit 20 are provided by hardware, the circuits are not necessarily provided physically individually. The functions of the circuits may be provided by a physically single circuit. The converting unit 10 and the fourth sub-pixel signal processing unit 20 are included in a color converting unit 50 according to the present embodiment. The display device 100 may further include an external information unit 11 that receives a luminance setting value set by a user or measures the illuminance of external light and receives information outside the display device, for example. Alternatively, the display device 100 may acquire the luminance setting value of the luminance of an image to be displayed on the image display unit 30 set by the user, information on the illuminance of external light, or the like from the external information unit 11 provided outside the display device 100 and transmit them to the color converting unit 50.

The converting unit 10 receives first color information for performing display on a predetermined pixel as a first input signal SRGB1. The first color information (first input signal SRGB1) is obtained based on an input video signal. The converting unit 10 converts the first color information corresponding to an input value in an HSV (Hue-Saturation-Value, Value is also called Brightness) color space into second color information by reducing the saturation by a saturation attenuation amount within a range where humans allow a change in the saturation. Thus, the converting unit 10 generates and outputs a second input signal SRGB 2. The first color information and the second color information are three-color input signals (R, G, B) each including a red (R) component, a green (G) component, and a blue (B) component.

The fourth sub-pixel signal processing unit 20 is coupled to the image display panel drive circuit 40 that drives the image display unit 30. The fourth sub-pixel signal processing unit 20, for example, converts an input value (second input signal SRGB2) of an input signal in the input HSV color space into an extended value (third input signal SRGBW) in an HSV color space extended by a first color, a second color, a third color, and a fourth color. The fourth sub-pixel signal processing unit 20 then outputs the third input signal SRGBW serving as an output signal to the image display unit 30. Thus, the fourth sub-pixel signal processing unit 20 converts the second color information in the second input signal SRGB2 into third color information having the R component, the G component, the B component, and an additional color component such as a white (W) component. The fourth sub-pixel signal processing unit 20 then outputs the third input signal SRGBW including the third color information to the drive circuit 40. The third color information is a four-color input signal (R, G, B, W). The additional color component is what is called a pure white component represented by respective gradations of the R component, the G component, and the B component of 256, that is, (R, G, B)=(255, 255, 255), for example. The embodiment is not limited thereto, and the color conversion is performed such that a color component represented by (R, G, B)=(255, 230, 204), for example, is displayed by a fourth sub-pixel as the additional color component.

While the present embodiment describes the conversion as processing for converting an input signal (e.g., RGB) into a signal in the HSV space, for example, the embodiment is not limited thereto. The input signal may be converted into a signal in an XYZ space, a YUV space, and other coordinate systems. The color gamut of a display, such as sRGB and Adobe (registered trademark) RGB, is represented by a triangular range on the xy chromaticity range in the XYZ color system. The predetermined color space indicating a defined color gamut is not necessarily represented by the triangular range and may be represented by a range of a desired shape, such as a polygon.

The fourth sub-pixel signal processing unit 20 outputs the generated output signal to the image display panel drive circuit 40. The drive circuit 40 is a control device for the image display unit 30 and includes a signal output circuit 41, a scanning circuit 42, and a power supply circuit 43. The drive circuit 40 holds the third input signals SRGBW including the third color information in the signal output circuit 41 and sequentially outputs the third input signals SRGBW to respective pixels 31 of the image display unit 30. The signal output circuit 41 is electrically coupled to the image display unit 30 via signal lines DTL. The drive circuit 40 selects sub-pixels in the image display unit 30 using the scanning circuit 42 and controls turning on and off of switching elements (e.g., thin-film transistors (TFT)) that control an operation (light emission luminance and/or light transmittance) of the respective sub-pixels. The scanning circuit 42 is electrically coupled to the image display unit 30 via scanning lines SCL. The power supply circuit 43 supplies electric power to light emitters, which will be described later, in the respective pixels 31 via power supply lines PCL.

The display device 100 may be various modifications described in Japanese Patent No. 3167026, Japanese Patent No. 3805150, Japanese Patent No. 4870358, Japanese Patent Application Laid-open Publication No. 2011-90118, and Japanese Patent Application Laid-open Publication No. 2006-3475.

As illustrated in FIG. 1, the image display unit 30 includes $P_0 \times Q_0$ pixels 31 ($P_0$ in the row direction and $Q_0$ in the column direction) arrayed in a two-dimensional matrix (rows and columns).

The pixels 31 each include a plurality of sub-pixels 32 and have lighting drive circuits of the sub-pixels 32 illustrated in FIG. 2 arrayed in a two-dimensional matrix (rows and columns). The lighting drive circuit includes a control transistor Tr1, a drive transistor Tr2, and a charge holding capacitor C1. The gate of the control transistor Tr1 is coupled to the scanning line SCL, the source is coupled to the signal line DTL, and the drain is coupled to the gate of the drive transistor Tr2. A first end of the charge holding capacitor C1 is coupled to the gate of the drive transistor Tr2, and a second end thereof is coupled to the source of the drive transistor Tr2. The source of the drive transistor Tr2 is coupled to the power supply line PCL, and the drain of the drive transistor Tr2 is coupled to the anode (positive electrode) of an organic light-emitting diode (OLED) E1 serving as a light emitter. The cathode (negative electrode) of the OLED E1 is coupled to a reference potential (e.g., a ground), for example.

While the control transistor Tr1 is an n-channel transistor, and the drive transistor Tr2 is a p-channel transistor in FIG. 2, the polarities of the transistors are not limited thereto. The respective polarities of the control transistor Tr1 and the drive transistor Tr2 may be determined as needed.

As illustrated in FIG. 3, the pixel 31 includes a first sub-pixel 32R, a second sub-pixel 32G, a third sub-pixel 32B, and a fourth sub-pixel 32W, for example. The first sub-pixel 32R displays a first primary color (e.g., the R component). The second sub-pixel 32G displays a second primary color (e.g., the G component). The third sub-pixel 32B displays a third primary color (e.g., the B component). The fourth sub-pixel 32W displays a fourth color (specifically, the W component) as an additional color component different from the first, the second, and the third primary colors. When it is not necessary to distinguish the first sub-pixel 32R, the second sub-pixel 32G, the third sub-pixel 32B, and the fourth sub-pixel 32W from one another, they are simply referred to as sub-pixels 32.

The image display unit 30 includes a substrate 51, insulation layers 52 and 53, reflective layers 54, lower electrodes 55, a light-emitting layer 56, an upper electrode 57, insulation layers 58 and 59, color filters 61R, 61G, 61B, and 61W serving as a color conversion layer, a black matrix 62 serving as a light-shielding layer, and a substrate 50 (refer to FIG. 4). The substrate 51 is a semiconductor substrate made of silicon or the like, a glass substrate, or a resin substrate, for example, and includes or holds the lighting drive circuit. The insulation layer 52 is a protective film that protects the lighting drive circuit and/or other components, and is made of a silicon oxide or a silicon nitride, for example. The respective lower electrodes 55 are provided to the first sub-pixel 32R, the second sub-pixel 32G, the third sub-pixel 32B, and the fourth sub-pixel 32W. The lower electrode 55 is a conductor serving as the anode of the OLED E1. The lower electrode 55 is a translucent electrode made of a translucent conductive material (translucent conductive oxide), such as an indium tin oxide (ITO). The insulation layer 53 is called a bank and separates the first sub-pixel 32R, the second sub-pixel 32G, the third sub-pixel 32B, and the fourth sub-pixel 32W from one another. The reflective layer 54 is made of a material having a metallic luster, such as silver, aluminum, and gold, that reflects light from the light-emitting layer 56. The light-emitting layer 56 is made of an organic material and includes a hole injection layer, a hole transport layer, a luminous layer, an electron transport layer, and an electron injection layer, which are not illustrated.

Hole Transport Layer

A layer that generates a hole is preferably a layer including an aromatic amine compound and a substance having an electron-accepting property for the compound, for example. The aromatic amine compound is a substance having an arylamine skeleton. Among aromatic amine compounds, preferably used is an aromatic amine compound including triphenylamine in the skeleton and having a molecular weight of equal to or larger than 400. Among aromatic amine compounds having triphenylamine in the skeleton, preferably used is an aromatic amine compound including a condensed aromatic ring, such as a naphthyl group, in the skeleton. By using the aromatic amine compound including triphenylamine and a condensed aromatic ring in the skeleton, it is possible to improve the heat resistance of light emitting elements. Examples of the aromatic amine compound include, but are not limited to, 4,4'-bis[N-(1-naphthyl)-N-phenylamino]biphenyl (abbreviation: α-NPD), 4,4'-bis[N-(3-methylphenyl)-N-phenylamino]biphenyl (abbreviation: TPD), 4,4',4"-tris(N,N-diphenylamino)triphenylamine (abbreviation: TDATA), 4,4',4"-tris[N-(3-methylphenyl)-N-phenylamino]triphenylamine (abbreviation: MTDATA), 4,4'-bis[N-{4-(N,N-di-m-tolylamino)phenyl}-N-phenylamino]biphenyl (abbreviation: DNTPD), 1,3,5-tris[N,N-di(m-tolyl)amino]benzene (abbreviation: m-MTDAB), 4,4',4"-tris(N-carbazolyl)triphenylamine (abbreviation: TCTA), 2,3-bis(4-diphenylaminophenyl)quinoxaline (abbreviation: TPAQn), 2,2',3,3'-tetrakis(4-diphenylaminophenyl)-6,6'-bisquinoxaline (abbreviation: D-TriPhAQn), 2,3-bis{4-N-(1-naphthyl)-N-phenylamino]phenyl}-dibenzo[f,h]quinoxaline (abbreviation: NPADiBzQn), etc. The substance having an electron-accepting property for the aromatic amine compound is not limited. Examples of the substance include, but are not limited to, a molybdenum oxide, a vanadium oxide, 7,7,8,8-tetracyanoquinodimethane (abbreviation: TCNQ), and 2,3,5,6-tetrafluoro-7,7,8,8-tetracyanoquinodimethane (abbreviation: F4-TCNQ).

Electron Injection Layer and Electron Transport Layer

An electron transport substance is not limited. Examples of the electron transport substance include, but are not limited to, a metal complex, such as tris(8-quinolinolato)aluminum (abbreviation: $Alq_3$), tris(4-methyl-8-quinolinolato)aluminum (abbreviation: $Almq_3$), bis(10-hydroxybenzo[h]-quinolinato)beryllium (abbreviation: $BeBq_2$), bis(2-methyl-8-quinolinolato)-4-phenylphenolate-aluminum (abbreviation: BAlq), bis[2-(2-hydroxyphenyl)benzoxazolate]zinc (abbreviation: $Zn(BOX)_2$), and bis[2-(2-hydroxyphenyl)benzothiazolate]zinc (abbreviation: $Zn(BTZ)_2$), 2-(4-biphenyl)-5-(4-tert-butylphenyl)-1,3,4-oxadiazole (abbreviation: PBD), 1,3-bis[5-(p-tert-butylphenyl)-1,3,4-oxadiazole-2-yl]benzene (abbreviation: OXD-7), 3-(4-tert-butylphenyl)-4-phenyl-5-(4-biphenyl)-1,2,4-triazole (abbreviation: TAZ), 3-(4-tert-butylphenyl)-4-(4-ethylphenyl)-5-(4-biphenyl)-1,2,4-triazole (abbreviation: p-EtTAZ), bathophenanthroline (abbreviation: BPhen), and bathocuproine (abbreviation: BCP). A substance having an electron-donating property for the electron transport substance is not limited. Examples of the substance include, but are not limited to, alkali metal such as lithium and cesium, alkaline-earth metal such as magnesium and calcium, and rare-earth metal such as erbium and ytterbium. A substance selected from alkali metal oxides and alkaline-earth metal oxide, such as a lithium oxide ($Li_2O$), a calcium oxide (CaO), a sodium oxide ($Na_2O$), a potassium oxide ($K_2O$), and a magnesium oxide (MgO), may be used as a substance having an electron-donating property for the electron transport substance.

Luminous Layer

To cause the luminous layer to emit red light, for example, a substance that emits light having a peak of an emission spectrum of 600 nm to 680 nm may be used. Examples of the substance include, but are not limited to, 4-dicyanomethylene-2-isopropyl-6-[2-(1,1,7,7-tetramethyljulolidine-9-yl)ethenyl]-4H-pyran (abbreviation: DCJTI), 4-dicyanomethylene-2-methyl-6-[2-(1,1,7,7-tetramethyljulolidine-9-yl)ethenyl]-4H-pyran (abbreviation: DCJT), 4-dicyanomethylene-2-tert-butyl-6-[2-(1,1,7,7-tetramethyljulolidine-9-yl)ethenyl]-4H-pyran (abbreviation: DCJTB), periflanthene, and 2,5-dicyano-1,4-bis[2-(10-methoxy-1,1,7,7-tetramethyljulolidine-9-yl)ethenyl]benzene. To cause the luminous layer to emit green light, a substance that emits light having a peak of an emission spectrum of 500 nm to 550 nm may be used. Examples of the substance include, but are not limited to, N,N'-dimethylquinacridone (abbreviation: DMQd), coumalin 6, coumalin 545T, and tris(8-quinolinolato)aluminum (abbreviation: $Alq_3$). To cause the luminous layer to emit blue light, a substance that emits light having a peak of an emission spectrum of 420 nm to 500 nm may be used. Examples of the substance include, but are not limited to, 9,10-bis(2-naphtyl)-tert-butylanthracene (abbreviation: t-BuDNA), 9,9'-bianthryl, 9,10-diphenylanthracene (abbreviation: DPA), 9,10-bis(2-naphtyl)-anthracene (abbreviation: DNA), bis(2-methyl-8-quinolinolato)-4-phenylphenolate-gallium (abbreviation: BGaq), and bis(2-methyl-8-quinolinolato)-4-phenylphenolate-alminum (abbreviation: BAlq). Besides the substances that emit fluorescence described above, a substance that emits phosphorescence may be used as the light-emitting substance. Examples of the substance include, but are not limited to, bis[2-(3,5-bis(trifluoromethyl)phenyl)pyridinate-N,C2']iridium(III)picolinate (abbreviation: $Ir(CF_3ppy)_2(pic)$), bis[2-(4,6-difluorophenyl)pyridinate-N,C2']iridium(III)acetylacetonate (abbreviation: FIr(acac)), bis[2-(4,6-difluorophenyl)pyridinate-N,C2']iridium(III)picolinate (abbreviation: FIr(pic)), and tris(2-phenylpyridinate-N,C2')iridium (abbreviation: $Ir(ppy)_3$).

The upper electrode 57 is a translucent electrode made of a translucent conductive material (translucent conductive oxide), such as an ITO. While the present embodiment uses an ITO as an example of the translucent conductive material, the material is not limited thereto. A conductive material having a different composition, such as an indium zinc oxide (IZO), may be used as the translucent conductive material. The upper electrode 57 serves as the cathode (negative electrode) of the OLED E1. The insulation layer 58 is a sealing layer that seals the upper electrode and is made of a silicon oxide or a silicon nitride, for example. The insulation layer 59 is a planarization layer that suppresses unevenness caused by the bank and is made of a silicon oxide or a silicon nitride, for example. The substrate 50 is a translucent substrate that protects the entire image display unit 30 and is a glass substrate, for example.

While the lower electrode 55 serves as the anode (positive electrode), and the upper electrode 57 serves as the cathode (negative electrode) in FIG. 4, the configuration is not limited thereto. Alternatively, the lower electrode 55 may serve as the cathode, and the upper electrode 57 may serve as the anode. In this case, the polarity of the drive transistor Tr2 electrically coupled to the lower electrode 55 can be optionally changed. The lamination order of a carrier injection layer (the hole injection layer and the electron injection layer), a carrier transport layer (the hole transport layer and the electron transport layer), and the luminous layer can be optionally changed.

The image display unit 30 is a color display panel. As illustrated in FIG. 4, the image display unit 30 includes a first color filter 61R, a second color filter 61G, a third color filter 61B, and a fourth color filter 61W. The first color filter 61R is arranged between the first sub-pixel 32R and an image observer to transmit first primary color light Lr out of the luminous components of the light-emitting layer 56. The second color filter 61G is arranged between the second sub-pixel 32G and the image observer to transmit second primary color light Lg out of the luminous components of the light-emitting layer 56. The third color filter 61B is arranged between the third sub-pixel 32B and the image observer to transmit third primary color light Lb out of the luminous components of the light-emitting layer 56. The fourth color filter 61W is arranged between the fourth sub-pixel 32W and the image observer to transmit a luminous component adjusted so as to be fourth primary color light Lw out of the luminous components of the light-emitting layer 56. The image display unit 30 can emit the fourth primary color light Lw having a color component different from those of the first primary color light Lr, the second primary color light Lg, and the third primary color light Lb from the fourth sub-pixel 32W. Alternatively, no color filter may be arranged between the fourth sub-pixel 32W and the image observer. Also in this case, the image display unit 30 can emit the fourth primary color light Lw having a color component different from those of the first primary color light Lr, the second primary color light Lg, and the third primary color light Lb from the fourth sub-pixel 32W without transmitting the luminous component of the light-emitting layer 56 through a color conversion layer, such as a color filter. The fourth sub-pixel 32W in the image display unit 30, for example, may be provided with a transparent resin layer instead of the fourth color filter 61*w* for color adjustment. With the transparent resin layer, the image display unit 30 can suppress great unevenness in the fourth sub-pixel 32W.

Figure 5:
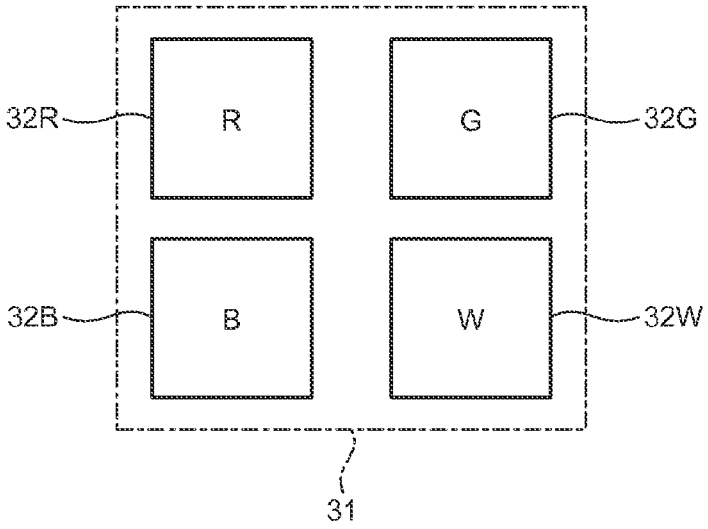
FIG. 5 is a diagram of another array of the sub-pixels in the image display unit according to the embodiment.

FIG. 5 is a diagram of another array of the sub-pixels in the image display unit according to the embodiment. The image display unit 30 includes the pixels 31 arranged in a matrix. The pixels 31 each include the first sub-pixel 32R, the second sub-pixel 32G, the third sub-pixel 32B, and the fourth sub-pixel 32W arrayed in two rows and two columns.

Figure 6:
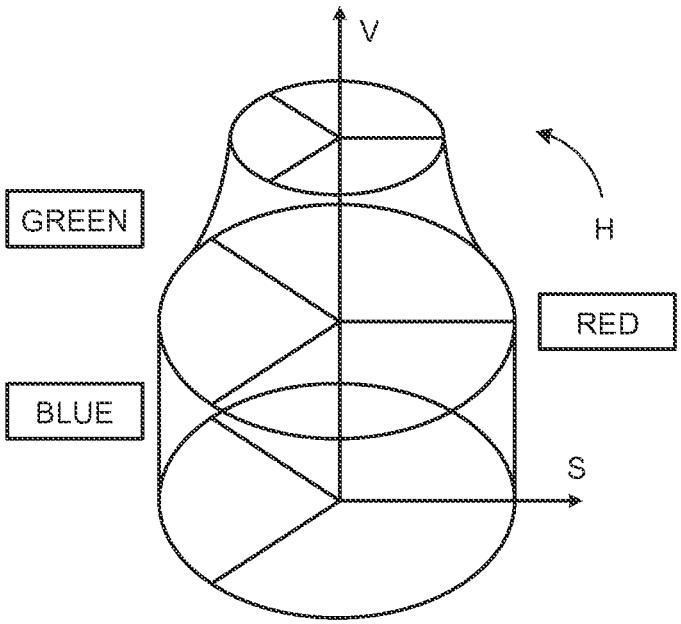
FIG. 6 is a conceptual diagram of an HSV color space extendable by the display device according to the embodiment.
Figure 7:
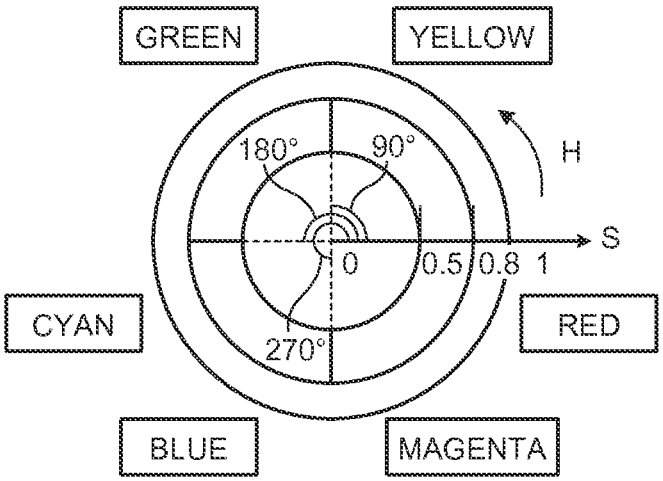
FIG. 7 is a conceptual diagram of the relation between the hue and the saturation in the HSV color space.

FIG. 6 is a conceptual diagram of an HSV color space extendable by the display device according to the embodiment. FIG. 7 is a conceptual diagram of the relation between the hue and the saturation in the HSV color space. By providing the fourth sub-pixel 32W that outputs the fourth color (white) to the pixel 31, the display device 100 broadens the dynamic range of the brightness in the HSV color space as illustrated in FIG. 6. In other words, the HSV color space has the shape illustrated in FIG. 6: a substantially truncated-cone-shaped solid is placed on a cylindrical HSV color space. The truncated-cone-shaped solid indicates that the maximum value of brightness V decreases as saturation S increases. The cylindrical HSV color space can be displayed by the first sub-pixel 32R, the second sub-pixel 32G, and the third sub-pixel 32B.

The first input signal SRGB1 has the input signal of the respective gradations of the R component, the G component, and the B component as the first color information. The first input signal SRGB1 corresponds to the cylindrical portion in the HSV color space, that is, the information on the cylindrical portion in the HSV color space illustrated in FIG. 6.

As illustrated in FIG. 7, a hue H is expressed by 0° to 360°. The hue H varies in order of red, yellow, green, cyan, blue, magenta, and red from 0° to 360°. In the embodiment, the area including an angle of 0° corresponds to red, the area including an angle of 120° corresponds to green, and the area including an angle of 240° corresponds to blue.

Exemplary Color Conversion

The color converting unit 50 according to the embodiment performs color conversion for converting the hue and/or the saturation of an original color within a range where humans hardly notice a change, thereby reducing the power consumption in the image display unit 30. The following describes exemplary color conversion.

Figure 8:
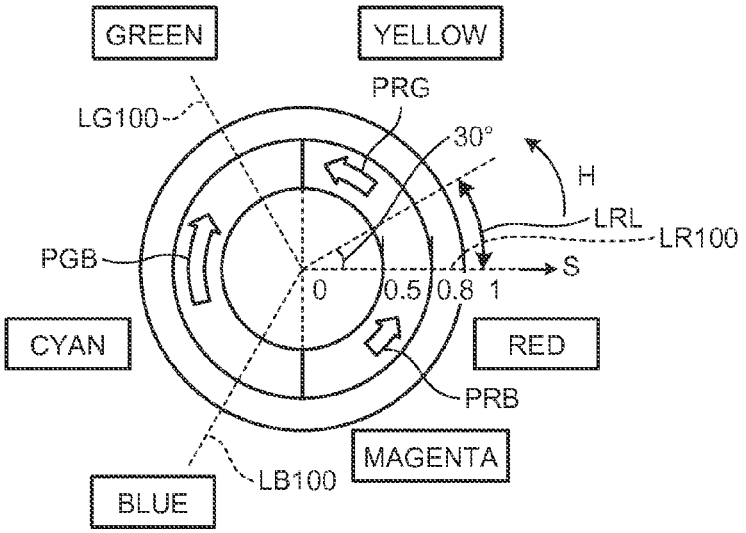
FIG. 8 is a conceptual diagram of hue conversion in the HSV color space according to the embodiment.
Figure 9:
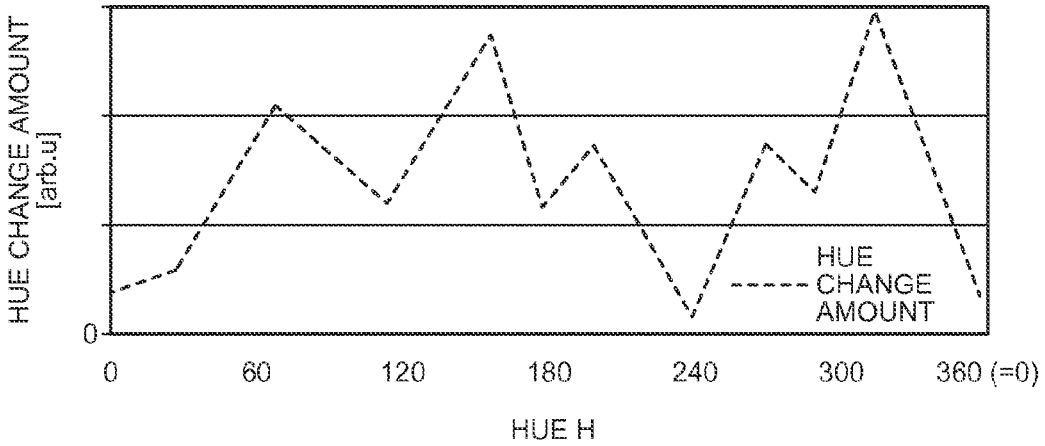
FIG. 9 is a diagram for explaining a look-up table indicating the relation between an original hue prior to conversion and a hue change amount within a range where humans allow a change in the hue according to the embodiment.
Figure 10:
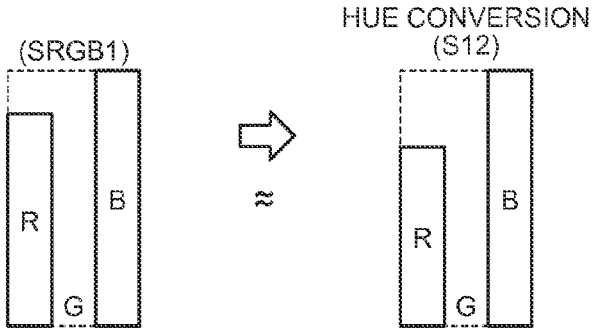
FIG. 10 is a diagram for explaining first exemplary color conversion according to the embodiment.
Figure 11:
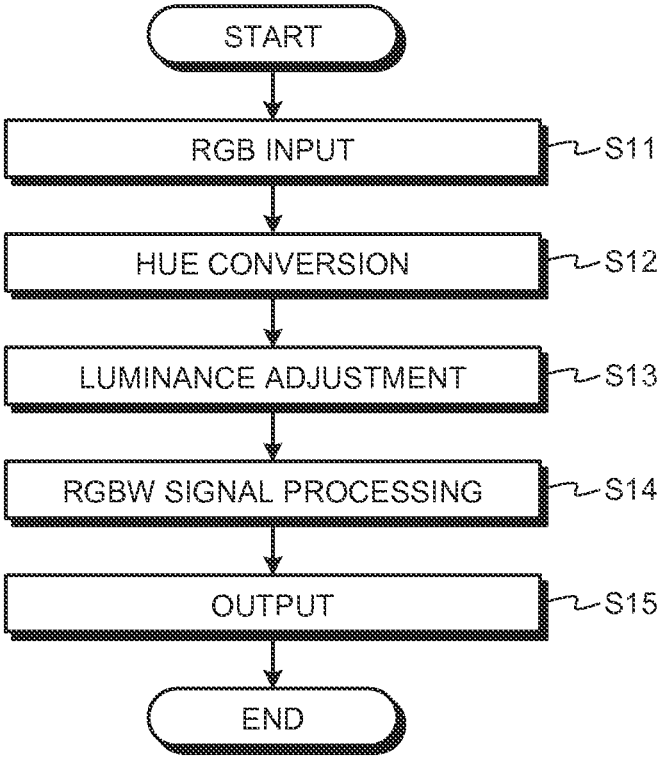
FIG. 11 is a flowchart for explaining a first color conversion method according to the embodiment.
Figure 12:
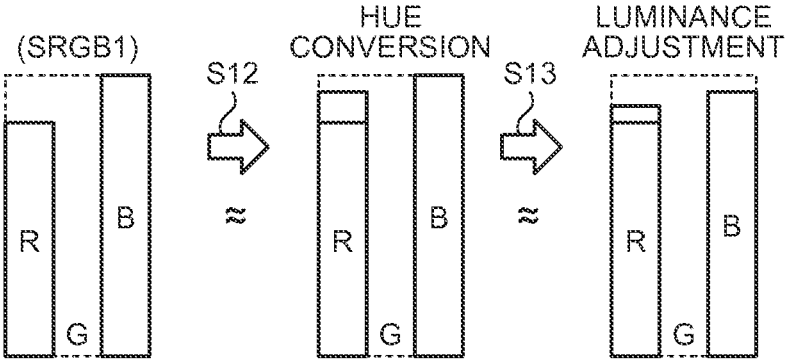
FIG. 12 is a diagram for explaining the first exemplary color conversion according to the embodiment.

First exemplary color conversion will be described. FIG. 8 is a conceptual diagram of hue conversion in the HSV color space according to the embodiment. FIG. 9 is a diagram for explaining a look-up table indicating the relation between an original hue prior to conversion and a hue change amount within a range where humans allow a change in the hue according to the embodiment. FIG. 10 is a diagram for explaining the first exemplary color conversion according to the embodiment. FIG. 11 is a flowchart for explaining a first color conversion method according to the embodiment. FIG. 12 is a diagram for explaining the first exemplary color conversion according to the embodiment.

As illustrated in FIG. 8, the hue H is easily recognized in an area LRL including an area LR 100 at an angle of 0° and an area at an angle of 0° to 30°, an area LG 100 at an angle of 120°, and an area LB 100 at an angle of 240°. The amount of conversion in the hue H in these areas should be set lower. It is found that, as for the hue H in the area beyond an angle of 30° and below the area LG 100, by shifting the hue H closer to green (closer to the area LG 100) by a hue change amount PRG, the power consumption is reduced, and the luminous efficiency is improved. It is also found that, as for the hue H in the area beyond the area LG 100 and below the area LB 100, by shifting the hue H closer to green (closer to the area LG 100) by a hue change amount PGB, the power consumption is reduced, and the luminous efficiency is improved. It is also found that, as for the hue H in the area beyond the area LB 100 and below the area LR 100, by shifting the hue H closer to red (closer to the area LR 100) by a hue change amount PRB, the power consumption is reduced, and the luminous efficiency is improved. This is because the luminance is higher in order of green, red, and blue. By performing conversion such that the hue of the second color information has higher luminance than that of the hue of the first color information, the power consumption is reduced. The converting unit 10 according to the embodiment stores therein information on the look-up table of the hue change amount with respect to the hue H illustrated in FIG. 9. Based on the look-up table illustrated in FIG. 9, the converting unit 10 calculates the hue change amounts PRG, PGB, and PRB.

In a color conversion method for converting an input signal supplied to the image display unit illustrated in FIG. 11, the converting unit 10 receives the first color information for performing display on a predetermined pixel as the first input signal SRGB1 (Step S11). The first color information is obtained based on an input video signal. The first color information is subjected to gamma conversion as needed, whereby a value in the RGB coordinate system is converted into an input value in the HSV color space.

The converting unit 10 according to the embodiment performs a hue conversion step (Step S12). In the hue conversion step, the converting unit 10 shifts the hue H of the original color by equal to or smaller than the hue change amounts PRG, PGB, and PRB within a range where humans hardly notice a change in the hue so as to reduce the total amount of lighting of the light emitters included in the first sub-pixel 32R, the second sub-pixel 32G, the third sub-pixel 32B, and the fourth sub-pixel 32W. According to the look-up table illustrated in FIG. 9, for example, it is difficult to increase the white component by performing conversion on the first input signal SRGB1 including the first color information including only the red component and the blue component (refer to FIG. 10) because the first color information has no green component. To address this, the converting unit 10 according to the embodiment shifts the hue H of the original color by equal to or smaller than the hue change amount PRB within a range where humans hardly notice a change in the hue so as to reduce the total amount of lighting of the light emitters included in the first sub-pixel 32R in a direction where the amount of lighting of the light emitters in the first sub-pixel 32R and the third sub-pixel 32B is reduced as illustrated in FIG. 10. Thus, the converting unit 10 reduces the amount of lighting of the light emitter in the first sub-pixel 32R.

Subsequently, the converting unit 10 performs a luminance adjustment step for performing an arithmetic operation to adjust the luminance such that the luminance of the second color information does not change from that of the first color information (Step S13). Because the difference in the luminance between the first color information and the second color information is small enough for humans to recognize, deterioration in the entire image is suppressed. According to the look-up table illustrated in FIG. 9, for example, it is difficult to increase the white component by performing conversion on the first input signal SRGB1 including the first color information including only the red component and the blue component (refer to FIG. 12), because the first color information has no green component. To address this, the converting unit 10 according to the embodiment shifts the hue H of the original color by equal to or smaller than the hue change amount PRB within a range where humans hardly notice a change in the hue in a color direction where the hue of the second color information has higher luminance than that of the hue of the first color information as illustrated in FIG. 12. Thus, the converting unit 10 increases the amount of lighting of the light emitter in the first sub-pixel 32R. While the luminance of the hue H resulting from the conversion is made higher, the levels of the red component, the green component, and the blue component, which are simple color components, are uniformly reduced by the luminance adjustment. As a result, the third input signal SRGBW resulting from an RGBW signal processing step (Step S14) has a smaller amount of lighting of the R component displayed by the first sub-pixel 32R and a smaller amount of lighting of the B component displayed by the third sub-pixel 32B.

Subsequently, the fourth sub-pixel signal processing unit 20 performs the RGBW signal processing step (Step S14). In the RGBW signal processing step, the fourth sub-pixel signal processing unit 20 converts the second input signal SRGB2 generated by the converting unit 10 into an extended value (third input signal SRGBW) in the HSV color space extended by the first, the second, the third, and the fourth colors and outputs the third input signal SRGBW serving as an output signal to the image display unit 30. Subsequently, the fourth sub-pixel signal processing unit 20 performs an output step (Step S15). In the output step, the fourth sub-pixel signal processing unit 20 outputs the third input signal SRGBW to the drive circuit 40 that controls drive of the image display unit 30. The third input signal SRGBW includes the third color information having the R component, the G component, the B component, and an additional color component such as the W component, and is generated based on the second color information in the second input signal SRGB2.

In the first exemplary color conversion, the hue conversion is performed such that the hue of the second information is shifted from the hue of the first information within a range where humans allow a change in the hue. As described above, the converting unit 10 receives the first color information for performing display on the predetermined pixel 31 as the first input signal SRGB. The first color information is obtained based on an input video signal. The converting unit 10 generates the second input signal SRGB2 including the second color information by shifting the hue of the first color information by the hue change amount within a range where humans allow a change in the hue. The converting unit 10 then outputs the generated second input signal SRGB 2. This operation reduces the total amount of lighting of the light emitters included in the first sub-pixel 32R, the second sub-pixel 32G, the third sub-pixel 32B, and the fourth sub-pixel 32W.

Because the original hue is shifted such that the luminance of the second color information does not change from that of the first color information, deterioration in an image on the image display unit 30 is hardly recognized by humans. As a result, the display device 100 can reduce the power consumption while suppressing deterioration (degradation) in the display quality as a whole.

The converting unit 10 shifts the hue by the hue change amount varying depending on the hue of the first color information. Because this operation makes the hue change amount smaller in the hue area where humans easily recognize a difference in the color, deterioration in the image is hardly recognized by humans. As a result, the display device 100 can reduce the power consumption while suppressing deterioration (degradation) in the display quality as a whole.

In a case where the first color information has no or a small amount of white component, the converting unit 10 can achieve reduction in the power consumption after the hue conversion step at Step S12. As a result, the display device 100 can reduce the power consumption while suppressing deterioration (degradation) in the display quality as a whole. Because the attenuation amount of the saturation decreases as the color is closer to a primary color, the difference in the color is hardly recognized by humans.

Figure 13:
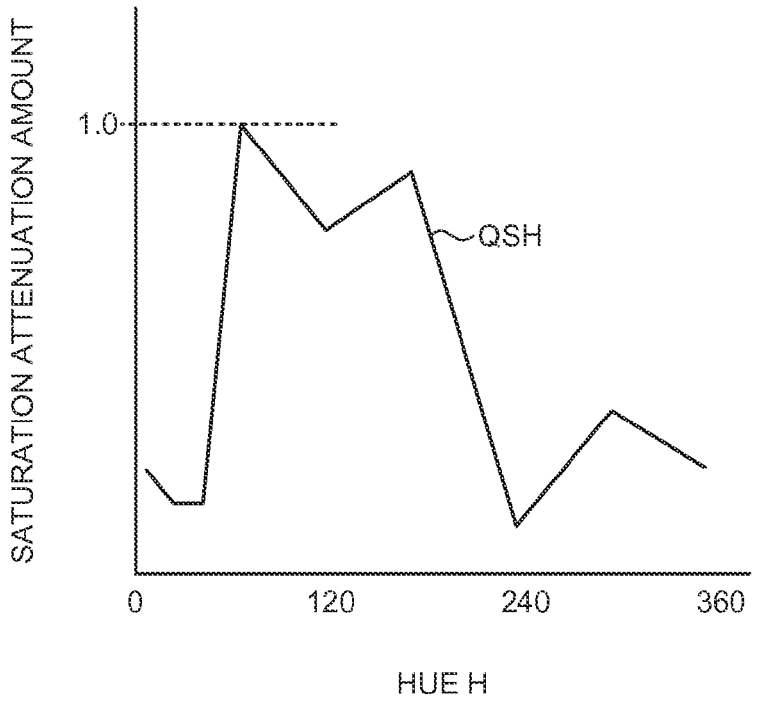
FIG. 13 is a diagram for explaining a look-up table indicating the relation between the hue and a saturation attenuation amount within a range where humans allow a change in the saturation according to the embodiment.
Figure 14:
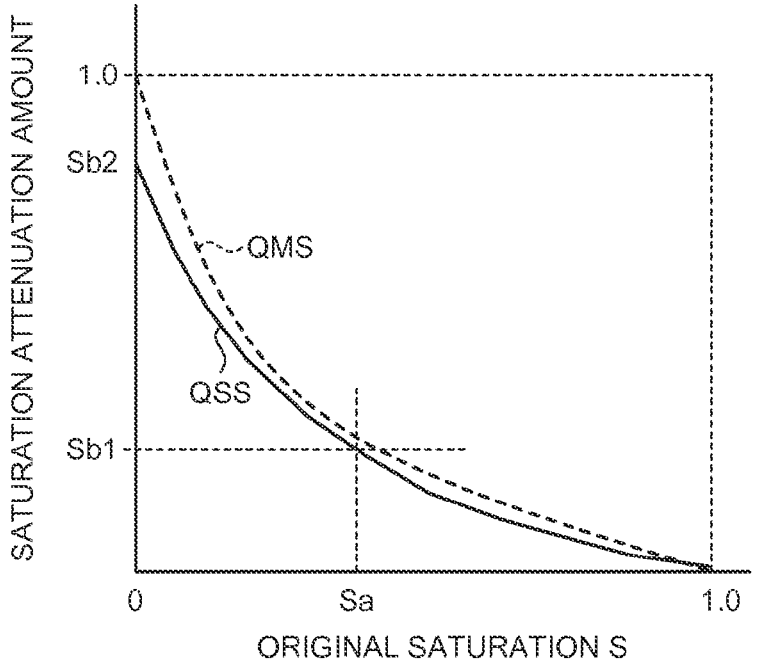
FIG. 14 is a diagram for explaining a look-up table indicating the relation between original saturation prior to conversion and the saturation attenuation amount within the range where humans allow the change in the saturation according to the embodiment.
Figure 15:
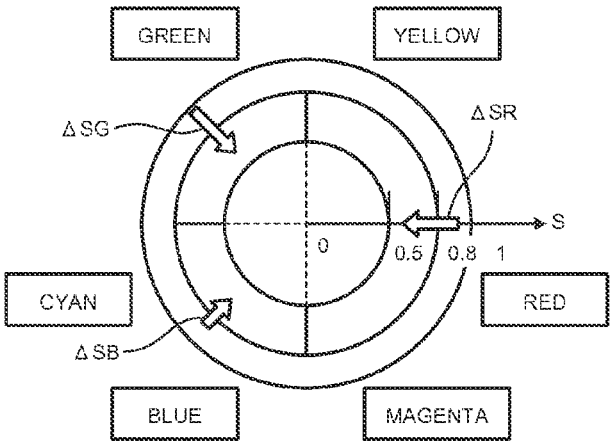
FIG. 15 is a conceptual diagram of the saturation attenuation amount in the HSV color space according to the embodiment.
Figure 16:
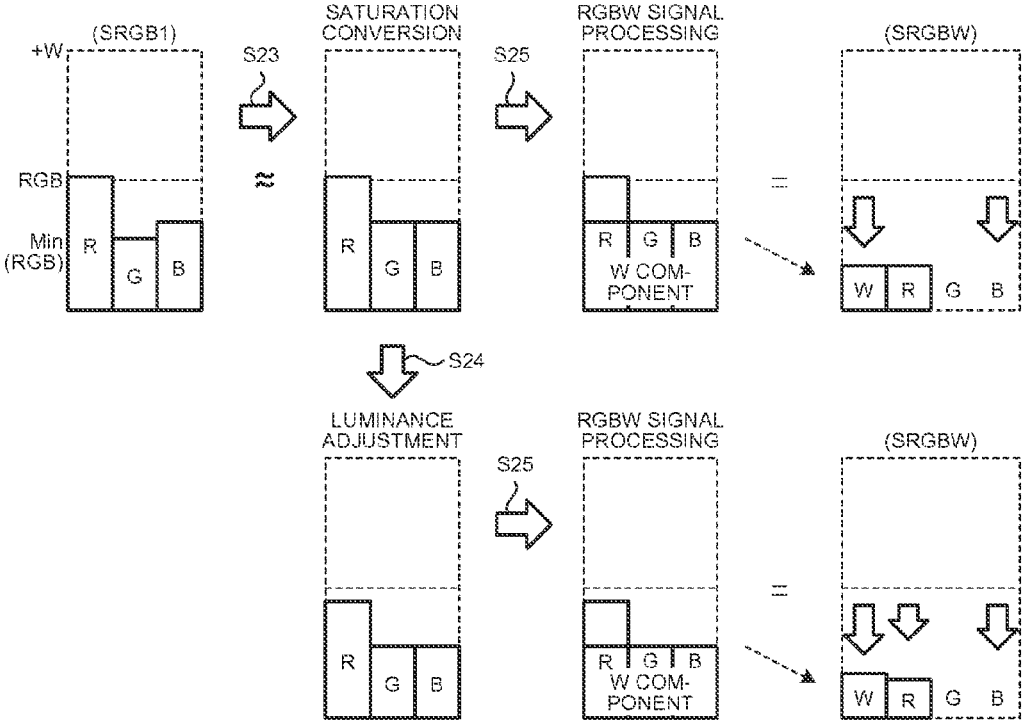
FIG. 16 is a diagram for explaining second exemplary color conversion according to the embodiment.
Figure 17:
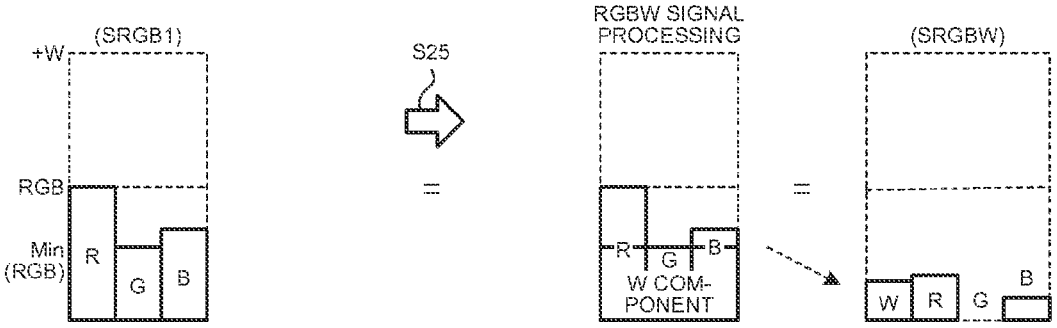
FIG.17 RELATED ART
FIG. 17 is a diagram for explaining exemplary color conversion according to a comparative example.
Figure 18:
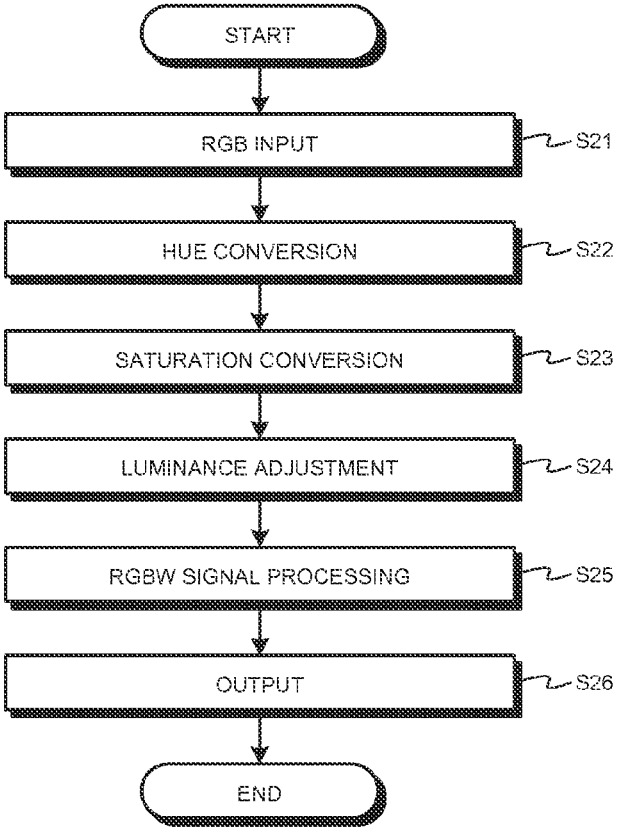
FIG. 18 is a flowchart for explaining a second color conversion method according to the embodiment.

Second exemplary color conversion will be described. The following describes processing operations performed by the display device 100, the converting unit 10, and the fourth sub-pixel signal processing unit 20. FIG. 13 is a diagram for explaining a look-up table indicating the relation between the hue and the saturation attenuation amount within a range where humans allow a change in the saturation according to the embodiment. FIG. 14 is a diagram for explaining a look-up table indicating the relation between original saturation prior to conversion and the saturation attenuation amount within the range where humans allow the change in the saturation according to the embodiment. FIG. 15 is a conceptual diagram of the saturation attenuation amount in the HSV color space according to the embodiment. FIG. 16 is a diagram for explaining the second exemplary color conversion according to the embodiment. FIG. 17 is a diagram for explaining exemplary color conversion according to a comparative example. FIG. 18 is a flowchart for explaining a second color conversion method according to the embodiment.

In a color conversion method for converting an input signal supplied to the image display unit illustrated in FIG. 18, the converting unit 10 receives the first color information for performing display on a predetermined pixel as the first input signal SRGB1 (Step S21). The first color information is obtained based on an input video signal. The first color information is subjected to gamma conversion as needed, whereby a value in the RGB coordinate system is converted into an input value in the HSV color space.

As illustrated in FIG. 18, the converting unit 10 performs the hue conversion step in the same manner as in the processing at Step S12 based on the information of the look-up table illustrated in FIG. 9 (Step S22).

As illustrated in FIG. 13, the saturation attenuation amount within a range where humans allow a change in the saturation varies depending on the hue H. The look-up table illustrated in FIG. 13 is first saturation conversion information indicating a gain value QSH with the saturation attenuation amount for each hue H plotted on the ordinate. As illustrated in FIG. 13, if the hue H is one of the red component corresponding to the area including an angle of 0° and the blue component corresponding to the area including an angle of 240°, the saturation attenuation amount within a range where humans allow a change in the saturation is small. Therefore, the saturation attenuation amount by which the converting unit 10 changes the saturation is made small.

As illustrated in FIG. 14, the saturation attenuation amount within a range where humans allow a change in the saturation varies depending on original saturation S. In the look-up table illustrated in FIG. 14, a curve of the lower limit of the saturation attenuation amount with which humans recognize the change in the saturation is plotted as a recognition characteristic curve QMS with respect to the original saturation S prior to the conversion performed by the converting unit 10. The converting unit 10 stores therein an approximate curve QSS plotted below the recognition characteristic curve QMS with respect to the same original saturation S as first saturation conversion information. The approximate curve QSS is stored in a manner falling below the average of the recognition characteristic curve QMS for the primary color of the red component, the primary color of the green component, and the primary color of the blue component in the hue H, for example. For more specific explanation, two lines having different inclinations are used in the approximate curve QSS, for example. When the original saturation S is saturation Sa, the saturation attenuation amount is Sb1; whereas when the original saturation is 0, the saturation attenuation amount is Sb2.

As illustrated in FIG. 15, the converting unit 10 calculates the gain value of the saturation attenuation amount in a manner restricted to any one of saturation attenuation amounts ΔSR, ΔSG, and ΔSB based on the information of the look-up tables illustrated in FIGS. 13 and 14. The converting unit 10 then multiplies the first color information corresponding to the input value in the HSV color space by the gain value, thereby performing a saturation conversion step (Step S23). The converting unit 10 uses the gain value obtained by multiplying the look-up tables illustrated in FIGS. 13 and 14, for example. This operation can provide a more accurate gain value for each hue H. Alternatively, the converting unit 10 uses the gain value obtained by adding up the look-up tables illustrated in FIGS. 13 and 14, for example. This operation can reduce the arithmetic load in the conversion.

As illustrated in FIG. 16, if the first input signal SRGB1 including the first color information is converted into the second input signal SRGB2 including the second color information by the saturation conversion step (Step S23), for example, the converting unit 10 calculates the saturation attenuation amount ΔSG so as to increase the G component. This operation increases the amount of the white component made of the red component, the green component, and the blue component of the same amount; the red, green and blue components being simple color components. Subsequently, the fourth sub-pixel signal processing unit 20 performs the RGBW signal processing step (Step S25) of converting the second input signal SRGB2 into an extended value (third input signal SRGBW) in the HSV color space extended by the first, the second, the third, and the fourth colors and outputting the third input signal SRGBW as serving an output signal to the image display unit 30. Thus, the power consumption in the pixel 31 corresponds to the amount of lighting of the R component displayed by the first sub-pixel 32R and the amount of lighting of the additional component (W), that is, the white component displayed by the fourth sub-pixel 32W.

In the exemplary color conversion according to the comparative example illustrated in FIG. 17, the RGBW signal processing step (Step S25) is performed without performing the saturation conversion step (Step S23). As a result, the power consumption in the pixel 31 corresponds to the amount of lighting of the R component displayed by the first sub-pixel 32R, the amount of lighting of the B component displayed by the third sub-pixel 32B, and the amount of lighting of the additional component (W), that is, the white component displayed by the fourth sub-pixel 32W. Compared with the processing in the comparative example, the color conversion method according to the first embodiment can increase the amount of lighting of the additional component (W), that is, the white component and decrease the simple color components. Thus, the color conversion method can reduce the power consumption in the pixel 31.

As illustrated in FIG. 18, the converting unit 10 performs the luminance adjustment step for performing an arithmetic operation to reduce the saturation such that the luminance of the second color information does not change from that of the first color information (Step S24). As illustrated in FIG. 16, for example, the luminance of the second color information appears to be higher than that of the first color information after the saturation conversion step (Step S23). The converting unit 10 adjusts the luminance such that the luminance of the second color information does not change from that of the first color information. While the saturation conversion step (Step S23) is performed after the hue conversion step (Step S22), the processing order is not limited thereto. The hue conversion step (Step S22) may be performed after the saturation conversion step (Step S23), or the hue conversion step (Step S22) and the saturation conversion step (Step S23) may be simultaneously performed.

As illustrated in FIG. 16, the levels of the red component, the green component, and the blue component, which are simple color components, are uniformly reduced by the luminance adjustment. As a result, the third input signal SRGBW resulting from the RGBW signal processing step (Step S25) has a smaller amount of lighting of the R component displayed by the first sub-pixel 32R and a smaller amount of lighting of the additional component (W), that is, the white component displayed by the fourth sub-pixel 32W. The difference in the luminance between the first color information and the second color information is so small that humans hardly recognize deterioration in the entire image.

Subsequently, the fourth sub-pixel signal processing unit 20 performs the output step (Step S26). In the output step, the fourth sub-pixel signal processing unit 20 outputs, to the drive circuit 40 that controls drive of the image display unit 30, the third input signal SRGBW including the third color information having the R component, the G component, the B component, and an additional color component such as the W component, generated based on the second color information in the second input signal SRGB2.

In a case where the total amount of lighting of the light emitters obtained by converting the first color information into the red component, the green component, the blue component, and the additional color component is smaller than that of the light emitters obtained by converting the second color information into the red component, the green component, the blue component, and the additional color component, the converting unit 10 outputs the first color information to the fourth sub-pixel signal processing unit 20 as the second color information. In the conversion of the first color information into the second color information by reducing the saturation by the saturation attenuation amount within a range where humans allow a change in the saturation, information identical to the first color information may be used as the second color information. This mechanism can prevent the power consumption in the pixel 31 from being increased by the saturation conversion step (Step S23).

In the second exemplary color conversion, the display device 100 attenuates the saturation of the original color (original saturation S) within a range where humans hardly notice a change in the saturation, thereby increasing the amount of lighting of the fourth sub-pixel 32W. Because the display device 100 attenuates the saturation of the original color (original saturation S) within a range where humans hardly notice a change in the saturation so as to reduce the total amount of lighting of the light emitters included in the first sub-pixel 32R, the second sub-pixel 32G, the third sub-pixel 32B, and the fourth sub-pixel 32W, the power consumption can be reduced. If the number of non-lighting sub-pixels 32 out of the first sub-pixel 32R, the second sub-pixel 32G, and the third sub-pixel 32B increases, the power consumption can be further reduced.

Because the original saturation S is attenuated such that the luminance of the second color information does not change from that of the first color information, deterioration in an image on the image display unit 30 is hardly recognized by humans. As a result, the display device 100 can reduce the power consumption while suppressing deterioration (degradation) in the display quality as a whole.

The converting unit 10 reduces the saturation by the saturation attenuation amount varying depending on the hue of the first color information. Because this operation makes the saturation attenuation amount smaller in the hue area where humans easily recognize a difference in the color, deterioration in the image is hardly recognized by humans. As a result, the display device 100 can reduce the power consumption while suppressing deterioration (degradation) in the display quality as a whole.

The converting unit 10 performs an arithmetic operation for reducing the saturation by a larger saturation attenuation amount as the saturation of the first color information is lower. Because the attenuation amount for lower saturation, which is hardly recognized by humans, is set larger, the converting unit 10 can achieve reduction in the power consumption after the saturation conversion step (Step S23). As a result, the display device 100 can reduce the power consumption while suppressing deterioration (degradation) in the display quality as a whole. Because the attenuation amount of the saturation decreases as the color is closer to a primary color, the difference in the color is hardly recognized by humans.

While the explanation has been made of the exemplary color conversions to reduce the power consumption in the image display unit 30, the color conversion is not limited to the examples described above. Any other color conversion that can reduce the total amount of lighting of the light emitters included in the first sub-pixel 32R, the second sub-pixel 32G, the third sub-pixel 32B, and the fourth sub-pixel 32W may be performed as a color conversion to reduce the power consumption in the image display unit 30.

While the explanation has been made of the exemplary color conversions of the image display unit 30 converting a three-color input signal into a four-color input signal and reducing the power consumption in the image display unit 30 that causes the light emitters including the four-color sub-pixels to light up, the image display unit 30 is not limited thereto. The image display unit 30 may be an image display unit that causes its light emitters including three-color sub-pixels to light up or a liquid-crystal panel including three-color or four-color sub-pixels, for example.

Figure 19:
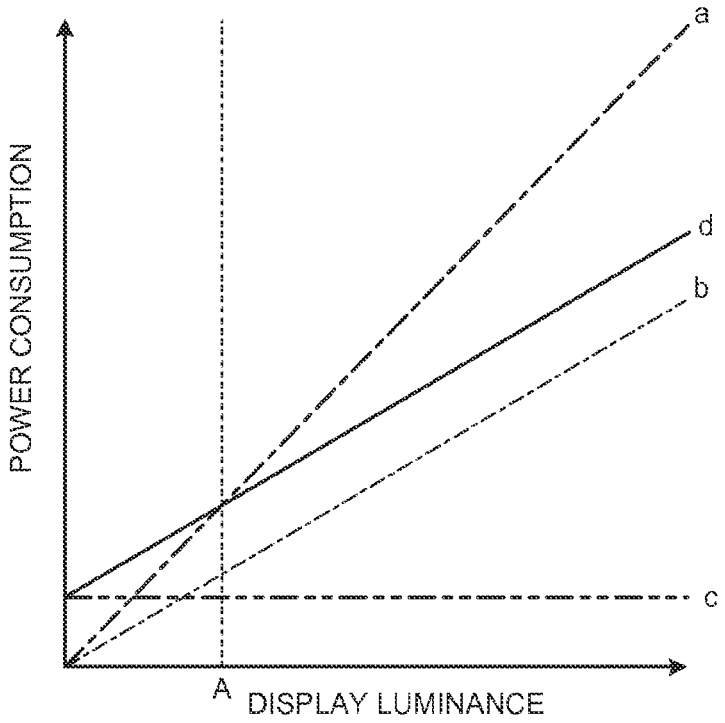
FIG.19 RELATED ART
FIG. 19 is a diagram schematically illustrating an example of the relation between the display luminance and the power consumption in the image display unit according to a comparative example.
Figure 20:
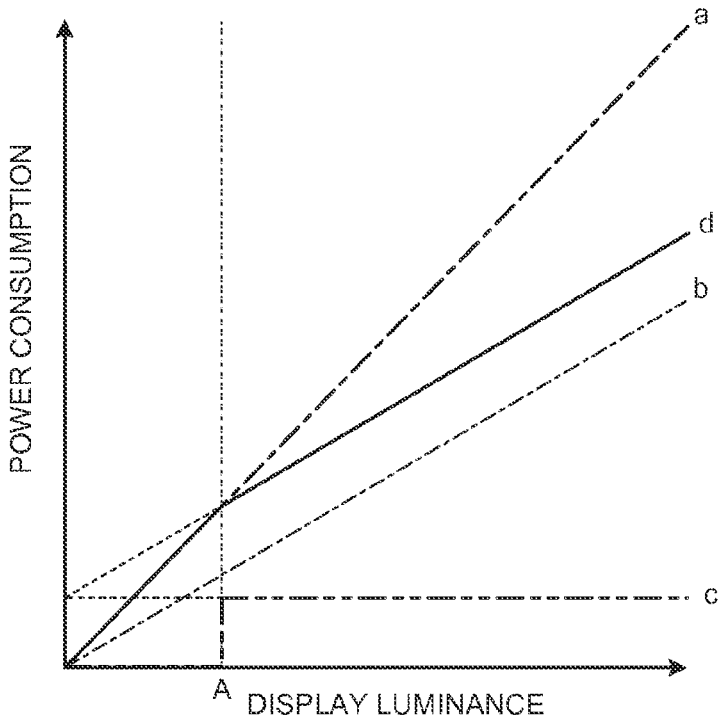
FIG. 20 is a diagram schematically illustrating an example of the relation between the display luminance and the power consumption in the image display unit of the display device according to a first embodiment.

The following describes a luminance range in which the color conversion is performed. FIG. 19 is a diagram schematically illustrating an example of the relation between the display luminance and the power consumption in the image display unit according to a comparative example. FIG. 20 is a diagram schematically illustrating an example of the relation between the display luminance and the power consumption in the image display unit of the display device according to the first embodiment. In the examples illustrated in FIGS. 19 and 20, the abscissa indicates the display luminance of the image display unit 30, and the ordinate indicates the power consumption. The display luminance of the image display unit 30 defines the luminance of the entire display area in the image display unit 30, such as the luminance per unit area in the display area of the image display unit 30 and the average of the luminance per unit area in the display area of the image display unit 30. The display luminance of the image display unit 30 is determined by a luminance setting value set by the user or a luminance setting value set based on the illuminance of external light measured by the external information unit 11, for example.

In the examples illustrated in FIGS. 19 and 20, the alternate long and short dash line a indicates the power consumption in the image display unit 30 in a case where no color conversion is performed. The alternate long and short dash line b indicates the power consumption in the image display unit 30 in a case where color conversion is performed. The alternate long and two short dashes line c indicates the power consumption in the color converting unit 50 in a case where color conversion is performed. The solid line d indicates the total power consumption obtained by adding up the power consumption in the image display unit 30 and that in the color converting unit 50 in a case where color conversion is performed.

As illustrated in FIG. 19, the power consumption in the image display unit 30 increases with an increase in the display luminance of an image displayed by the image display unit 30 (alternate long and short dash line a). By contrast, the power consumption in the color converting unit 50 is constant independently of an increase in the display luminance of the image displayed by the image display unit 30 (alternate long and two short dashes line c).

The color conversion is performed by the color converting unit 50 to reduce the total amount of lighting of the light emitters included in the first sub-pixel 32R, the second sub-pixel 32G, the third sub-pixel 32B, and the fourth sub-pixel 32W. The color conversion is performed to increase the amount of reduction in the power consumption in the image display unit 30 with an increase in the display luminance of an image displayed by the image display unit 30. By performing the color conversion, the power consumption in the image display unit 30 is reduced at a constant rate in the entire display luminance range of the image display unit 30 (alternate long and short dash line b) compared with a case where no color conversion is performed.

In the comparative example illustrated in FIG. 19, the amount of reduction in the power consumption in the image display unit 30 caused by the color conversion corresponds to the difference between the power consumption in the image display unit 30 in a case where no color conversion is performed (alternate long and short dash line a) and the power consumption in the image display unit 30 in a case where color conversion is performed (alternate long and short dash line b). In a case where color conversion is performed, however, it is necessary to consider the power consumption in the color converting unit 50 (alternate long and two short dashes line c) besides the power consumption in the image display unit 30 (alternate long and short dash line b).

As illustrated in FIG. 19, in a case where color conversion is performed in the entire display luminance range of the image display unit 30, the total power consumption (solid line d) obtained by adding up the power consumption in the image display unit 30 and that in the color converting unit 50 may possibly exceed the power consumption in the image display unit 30 in a case where no color conversion is performed (alternate long and short dash line a). Specifically, in a display luminance range lower than display luminance A at which the total power consumption in a case where color conversion is performed (solid line d) intersects with the power consumption in the image display unit 30 in a case where no color conversion is performed (alternate long and short dash line a), performing no color conversion makes the power consumption in the entire display device 100 smaller.

As illustrated in FIG. 20, the color converting unit 50 according to the first embodiment does not perform color conversion in the display luminance range lower than the display luminance A at which the total power consumption in a case where color conversion is performed (solid line d) intersects with the power consumption in the image display unit 30 in a case where no color conversion is performed (alternate long and short dash line a) in the comparative example illustrated in FIG. 19.

This configuration can reduce the total power consumption obtained by adding up the power consumption in the image display unit 30 and that in the color converting unit 50 in the entire display luminance range of the image display unit 30. Thus, it is possible to reduce the power consumption in the entire display device 100 and the power consumption in an electronic apparatus to which the display device 100 is applied.

The display luminance range in which no color conversion is performed may be determined by: setting in advance, in the color converting unit 50, a luminance setting threshold corresponding to the display luminance A at which the total power consumption obtained by adding up the power consumption in the image display unit 30 and that in the color converting unit 50 in a case where color conversion is performed in the entire display luminance range of the image display unit 30 intersects with the power consumption in the image display unit 30 in a case where no color conversion is performed; and determining the range smaller than the luminance setting threshold to be the luminance setting range in which no color conversion is performed.

In this case, the color converting unit 50 compares the luminance setting value set in the display device 100 with the luminance setting threshold, thereby determining whether to perform color conversion.

Various types of the luminance setting value may be used, including luminance setting information received from the external information unit 11. Examples of the luminance setting information include, but are not limited to, a luminance setting value set by the user or a luminance setting value set based on the illuminance of external light and the like measured by the external information unit 11.

With this configuration, the color converting unit 50 can determine whether to perform color conversion based on the result of comparison between the luminance setting value set by the user or the illuminance of external light and the luminance setting threshold.

If the luminance setting value is smaller than the luminance setting threshold, the color converting unit 50 does not perform color conversion. In other words, if the luminance setting value is equal to or larger than the luminance setting threshold, the color converting unit 50 performs color conversion.

In the display device 100 and the color conversion method according to the first embodiment, the color converting unit 50 performs color conversion to reduce the power consumption in the image display unit 30 as follows: the color converting unit 50 performs no color conversion in an area where the total power consumption obtained by adding up the power consumption in the image display unit 30 and that in the color converting unit 50 in a case where color conversion is performed exceeds the power consumption in the image display unit 30 in a case where no color conversion is performed. Specifically, the color converting unit 50 performs no color conversion in the display luminance range lower than the display luminance A. The display luminance A is a boundary luminance at which the magnitude relation between the total power consumption (the power consumption represented by the solid line d in FIG. 19) in a case where color conversion is performed and the power consumption (the power consumption represented by the solid line a in FIG. 19) in the image display unit 30 in a case where no color conversion is performed is inverted. In the display luminance range, the total power consumption obtained by adding up the power consumption in the image display unit 30 and that in the color converting unit 50 in a case where color conversion is performed in the entire display luminance range of the image display unit 30 is larger than the power consumption in the image display unit 30 in a case where no color conversion is performed. This configuration can reduce the total power consumption obtained by adding up the power consumption in the image display unit 30 and that in the color converting unit 50 in the entire display luminance range of the image display unit 30. Thus, it is possible to reduce the power consumption in the entire display device 100 and the power consumption in an electronic apparatus to which the display device 100 is applied.

The display luminance setting threshold is set in the color converting unit 50 in advance. The display luminance setting threshold corresponds to the display luminance A at which the total power consumption obtained by adding up the power consumption in the image display unit 30 and that in the color converting unit 50 in a case where color conversion is performed in the entire luminance range of the image display unit 30 intersects with the power consumption in the image display unit 30 in a case where no color conversion is performed. Thus, the color converting unit 50 can determine whether to perform color conversion based on the result of comparison between the luminance setting value set by the user or the illuminance of external light and the luminance setting threshold.

The present embodiment can provide the display device and the color conversion method capable of reducing the power consumption in a low-luminance state with a configuration that performs color conversion to reduce the power consumption in the image display unit.

Second Embodiment

The color converting unit 50 according to the first embodiment performs no color conversion in the display luminance range lower than the display luminance A. At the display luminance A, the total power consumption obtained by adding up the power consumption in the image display unit 30 and that in the color converting unit 50 in a case where color conversion is performed in the entire display luminance range of the image display unit 30 intersects with the power consumption in the image display unit 30 in a case where no color conversion is performed. In this case, the color converting unit 50 performs no color conversion in the display luminance range lower than the display luminance A and performs color conversion in the display luminance range equal to or higher than the display luminance A. As a result, a change in the display quality is caused by presence or absence of color conversion before and after the display luminance A and may possibly exceed the range where humans allow a change in the display quality caused by color conversion. A second embodiment gradually raises a color conversion level indicating the degree of a change in the display quality caused by color conversion within a range where humans allow a change in the display quality caused by color conversion in the display luminance range equal to or higher than the display luminance A. In other words, the second embodiment gradually raises the color conversion level indicating the degree of a change in the hue in the first exemplary color conversion, and the degree of a change in the saturation and the degree of a change in the luminance in the second exemplary color conversion described in the first embodiment.

Figure 21:
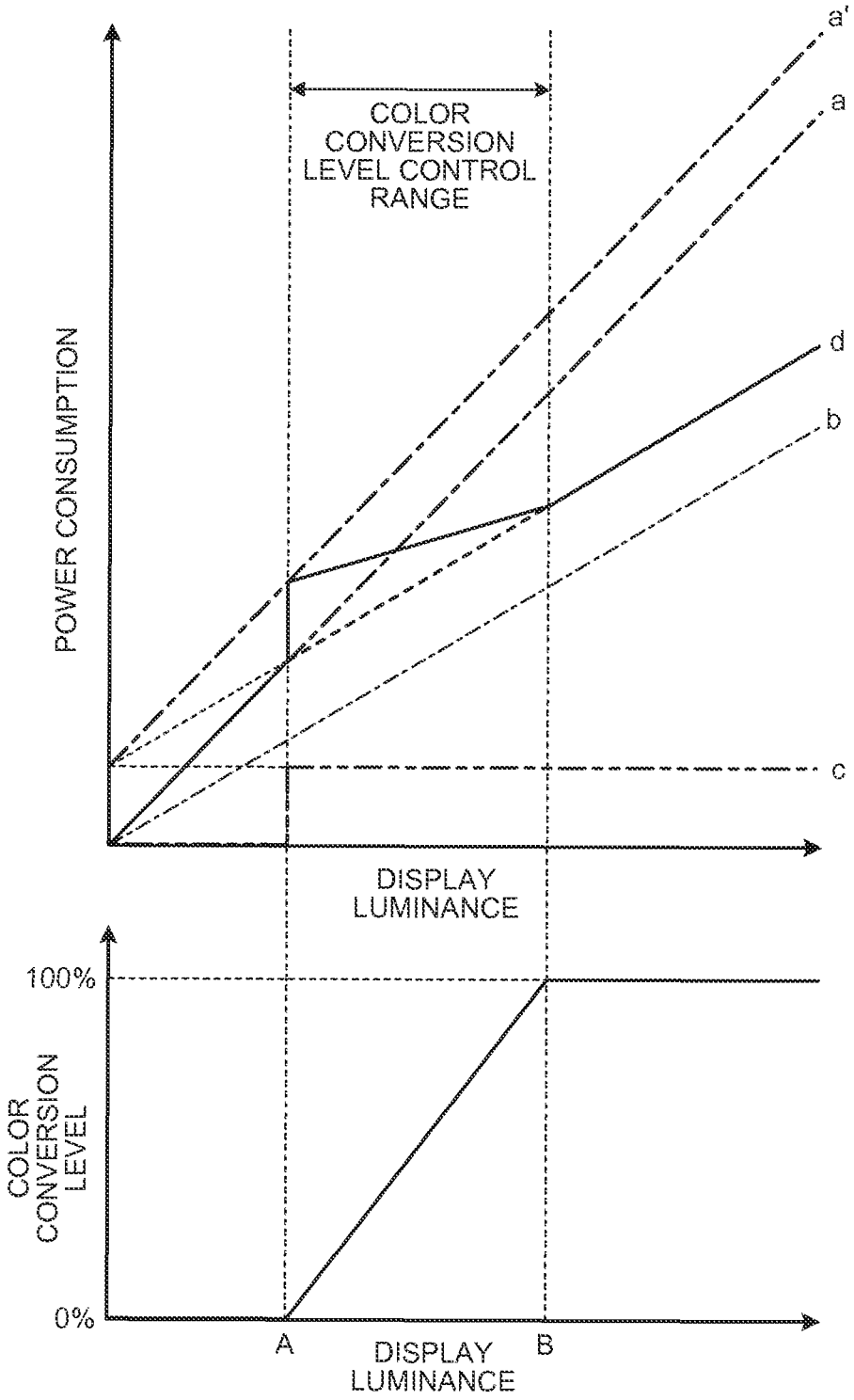
FIG. 21 is a diagram schematically illustrating an example of the relation between the display luminance and the power consumption in the image display unit and the relation between the display luminance and the color conversion level in the image display unit of the display device according to a second embodiment.

FIG. 21 is a diagram schematically illustrating an example of the relation between the display luminance and the power consumption in the image display unit and the relation between the display luminance and the color conversion level in the image display unit of the display device according to the second embodiment. Because the configuration of the display device 100 according to the second embodiment is the same as that of the first embodiment, explanation thereof will be omitted.

In the example illustrated in FIG. 21, the alternate long and short dash line a' indicates the total power consumption obtained by adding up the power consumption in the image display unit 30 and that in the color converting unit 50 at a color conversion level of 0%, that is, in a state where the color converting unit 50 is operating but is not virtually performing color conversion.

As illustrated in FIG. 21, the second embodiment determines the luminance range equal to or higher than the display luminance A and equal to or lower than display luminance B to be a color conversion level control range, the display luminance B being higher than the display luminance A.

In the example illustrated in FIG. 21, no color conversion is performed in the display luminance range lower than the display luminance A similarly to the first embodiment. In the display luminance range higher than the display luminance B, the color conversion level in the color conversion is set to 100%.

By contrast, in the color conversion level control range, the color converting unit 50 gradually raises the color conversion level in the color conversion from 0% to 100% from the display luminance A to the display luminance B.

The color conversion level control range may be determined by: setting two luminance setting thresholds (a first luminance setting threshold and a second luminance setting threshold) in the color converting unit 50; and determining a range equal to or larger than the first luminance setting threshold and equal to or smaller than the second luminance setting threshold to be the color conversion level control range. The first luminance setting threshold corresponds to the display luminance A at which the total power consumption obtained by adding up the power consumption in the image display unit 30 and that in the color converting unit 50 in a case where color conversion is performed in the entire display luminance range of the image display unit 30 intersects with the power consumption in the image display unit 30 in a case where no color conversion is performed. The second luminance setting threshold corresponds to the display luminance B, which is higher than the display luminance A.

The color converting unit 50 compares the luminance setting value set in the display device 100 with the first and the second luminance setting thresholds. If the luminance setting value is equal to or larger than the first luminance setting threshold and equal to or smaller than the second luminance setting threshold, the color converting unit 50 determines that the luminance setting value falls within the color conversion level control range.

In this case, the range from the first luminance setting threshold to the second luminance setting threshold is divided into a plurality of sections, for example. The color converting unit 50 stores therein a look-up table in which the color conversion level gradually rises in units of a section from the first luminance setting threshold to the second luminance setting threshold.

With this configuration, the color converting unit 50 can perform color conversion at a color conversion level corresponding to the luminance setting value.

If the luminance setting value is equal to or larger than the first luminance setting threshold and equal to or smaller than the second luminance setting threshold, the color converting unit 50 reads the color conversion level corresponding to the luminance setting value from the look-up table, and performs color conversion at the read color conversion level.

In the example above, the color converting unit 50 reads the color conversion level corresponding to the luminance setting value from the look-up table. Needless to say, the color converting unit 50 may use an arithmetic expression to derive the color conversion level corresponding to the luminance setting value.

As described above, the second embodiment gradually raises the color conversion level in color conversion within a range where humans allow a change in the display quality caused by the color conversion in the display luminance range equal to or higher than the display luminance A. At the display luminance A, the total power consumption obtained by adding up the power consumption in the image display unit 30 and that in the color converting unit 50 in a case where color conversion is performed in the entire display luminance range of the image display unit 30 intersects with the power consumption in the image display unit 30 in a case where no color conversion is performed. Specifically, in the second embodiment, in the color converting unit 50, a luminance setting threshold (first luminance setting threshold) corresponding to the display luminance A and a luminance setting threshold (second luminance setting threshold) corresponding to the display luminance B, which is higher than the display luminance A, are set. In the second embodiment, the range from the first luminance setting threshold to the second luminance setting threshold is divided into a plurality of sections. In the second embodiment, in the color converting unit 50, a look-up table in which the color conversion level gradually rises in units of a section from the first luminance setting threshold to the second luminance setting threshold is set. The color converting unit 50 reads the color conversion level corresponding to the luminance setting value from the look-up table, thereby performing color conversion at the color conversion level corresponding to the luminance setting value. Thus, in the second embodiment, the change in the display quality caused by the color conversion varying depending on the luminance setting value can be kept within a range where humans allow a change.

The present embodiment can provide the display device and the color conversion method capable of reducing the power consumption in a low-luminance state with a configuration that performs color conversion to reduce the power consumption in the image display unit.

Third Embodiment

The second embodiment determines the display luminance range equal to or higher than the display luminance A and equal to or lower than the display luminance B, which is higher than the display luminance A, to be the color conversion level control range. At the display luminance A, the total power consumption obtained by adding up the power consumption in the image display unit 30 and that in the color converting unit 50 in a case where color conversion is performed in the entire display luminance range of the image display unit 30 intersects with the power consumption in the image display unit 30 in a case where no color conversion is performed. The second embodiment gradually raises the color conversion level in the color conversion level control range. In this case, the power consumption is made discontinuous before and after the display luminance A. As a result, the power consumption may possibly be larger than that in a case where no color conversion is performed in a section equal to or higher than the display luminance A. A third embodiment performs color conversion in a time-division manner in the display luminance range equal to or higher than the display luminance A.

Figure 22:
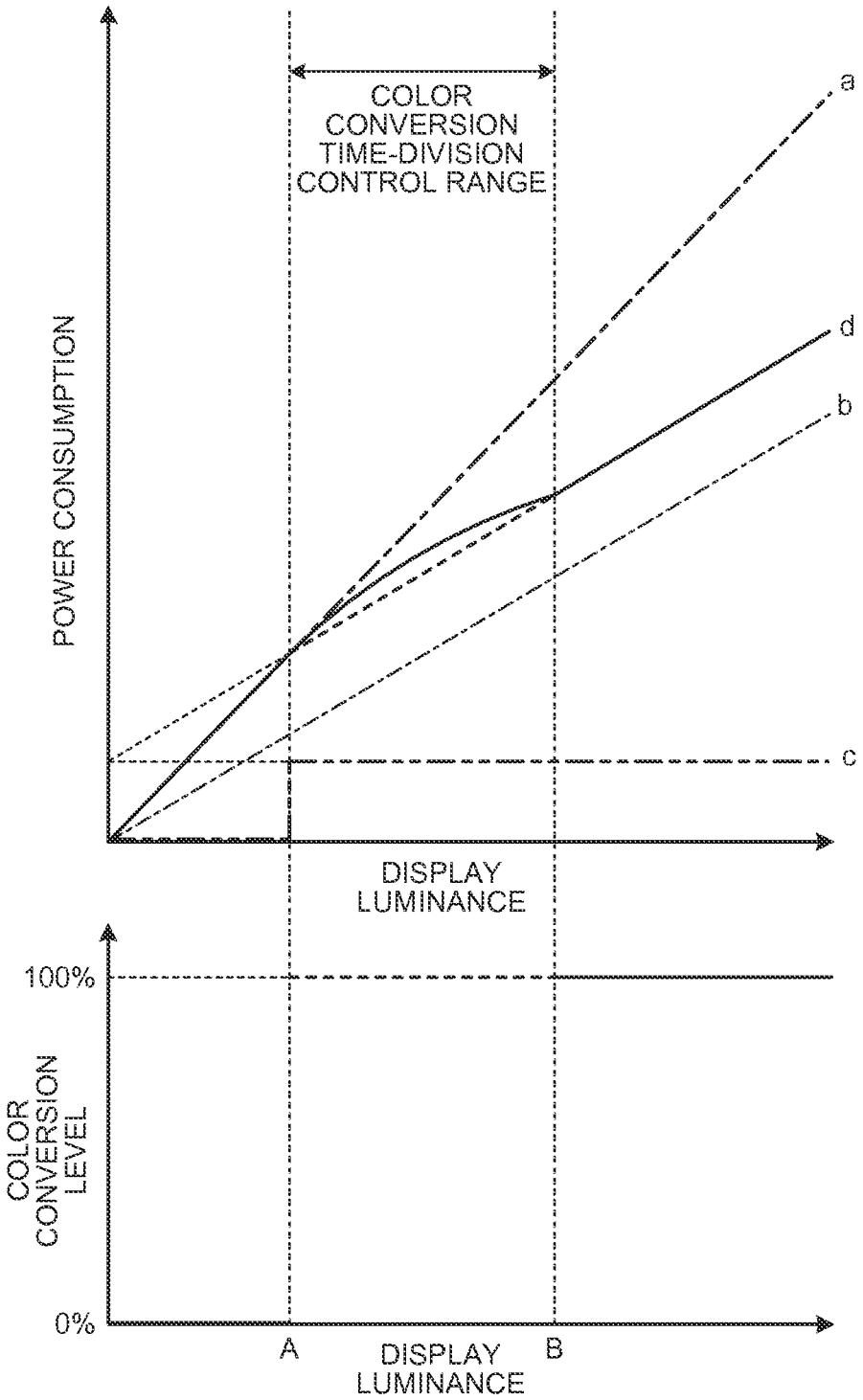
FIG. 22 is a diagram schematically illustrating an example of the relation between the display luminance and the power consumption in the image display unit and the relation between the display luminance and the color conversion level in the image display unit of the display device according to a third embodiment.

FIG. 22 is a diagram schematically illustrating an example of the relation between the display luminance and the power consumption in the image display unit, and, the relation between the display luminance and the color conversion level in the image display unit of the display device according to the third embodiment. Because the configuration of the display device 100 according to the third embodiment is the same as that of the first embodiment, explanation thereof will be omitted.

As illustrated in FIG. 22, the third embodiment determines the display luminance range equal to or higher than the display luminance A and equal to or lower than the display luminance B to be a color conversion time-division control range, the display luminance B being higher than the display luminance A.

In the example illustrated in FIG. 22, no color conversion is performed in the display luminance range lower than the display luminance A similarly to the first and the second embodiments. In the display luminance range higher than the display luminance B, color conversion is continuously performed not in a time-division manner.

By contrast, in the color conversion time-division control range, the color converting unit 50 performs color conversion intermittently, that is, in a time-division manner. The color converting unit 50, for example, performs color conversion on an image to be displayed on the image display unit 30 in units of a frame. In other words, the color converting unit 50 performs color conversion on some of a plurality of frames and performs no color conversion on the rest of them.

Similarly to the second embodiment, the color conversion time-division control range may be determined by: setting two luminance setting thresholds (a first luminance setting threshold and a second luminance setting threshold) in the color converting unit 50; and determining the range equal to or larger than the first luminance setting threshold and equal to or smaller than the second luminance setting threshold to be the color conversion time-division control range. The first luminance setting threshold corresponds to the display luminance A at which the total power consumption obtained by adding up the power consumption in the image display unit 30 and that in the color converting unit 50 in a case where color conversion is performed in the entire display luminance range of the image display unit 30 intersects with the power consumption in the image display unit 30 in a case where no color conversion is performed. The second luminance setting threshold corresponds to the display luminance B, which is higher than the display luminance A.

The color converting unit 50 compares the luminance setting value set in the display device 100 with the first and the second luminance setting thresholds. If the luminance setting value is equal to or larger than the first luminance setting threshold and equal to or smaller than the second luminance setting threshold, the color converting unit 50 determines that the luminance setting value falls within the color conversion time-division control range.

In this case, the range from the first luminance setting threshold to the second luminance setting threshold is divided into a plurality of sections, for example. A frame rate at which the color conversion is performed is determined in each section. As illustrated in FIG. 22, the color converting unit 50 stores therein a look-up table defining the frame rate of each section to prevent the power consumption in the range from exceeding the power consumption (alternate long and short dash line a) in the image display unit 30 in a case where no color conversion is performed.

With this configuration, the color converting unit 50 can perform color conversion at a frame rate corresponding to the luminance setting value.

If the luminance setting value is equal to or larger than the first luminance setting threshold and equal to or smaller than the second luminance setting threshold, the color converting unit 50 reads the frame rate corresponding to the luminance setting value from the look-up table, and performs color conversion at the read frame rate.

In the example above, the color converting unit 50 reads the frame rate corresponding to the luminance setting value from the look-up table. Needless to say, the color converting unit 50 may use an arithmetic expression to derive the frame rate corresponding to the luminance setting value.

Besides the frame rate in each section, frames on which color conversion is performed and frames on which no color conversion is performed may be determined out of the frames. In this case, to prevent a flicker, the frames on which color conversion is performed or the frames on which no color conversion is performed are preferably arranged as discontinuously as possible.

The flicker can also be prevented by shifting the timing of color conversion for each horizontal line or for each pixel in the image display unit 30.

As described above, the third embodiment prevents the power consumption in the display luminance range equal to or higher than the display luminance A from exceeding the power consumption in the image display unit 30 in a case where no color conversion is performed. At the display luminance A, the total power consumption obtained by adding up the power consumption in the image display unit 30 and that in the color converting unit 50 in a case where color conversion is performed in the entire display luminance range of the image display unit 30 intersects with the power consumption in the image display unit 30 in a case where no color conversion is performed. Specifically, in the third embodiment, in the color converting unit 50, a luminance setting threshold (first luminance setting threshold) corresponding to the display luminance A and a luminance setting threshold (second luminance setting threshold) corresponding to the display luminance B, which is higher than the display luminance A, are set. In the third embodiment, the range from the first luminance setting threshold to the second luminance setting threshold are divided into a plurality of sections. In the third embodiment, a frame rate at which the color conversion is performed is determined in each section. In the third embodiment, in the color converting unit 50, a look-up table defining the frame rate of each section is set so as to prevent the power consumption in the range from exceeding the power consumption in the image display unit 30 in a case where no color conversion is performed. The color converting unit 50 reads the frame rate corresponding to the luminance setting value from the look-up table, thereby performing color conversion at the frame rate corresponding to the luminance setting value. With this configuration, the third embodiment can prevent the power consumption from being discontinuous before and after the display luminance A. Thus, the third embodiment can reduce the power consumption in the entire display luminance range displayable by the image display unit 30.

The third embodiment can prevent a flicker by arranging frames on which color conversion is performed or frames on which no color conversion is performed out of a plurality of frames as discontinuously as possible. Alternatively, the third embodiment can prevent a flicker by shifting the timing of color conversion in each horizontal line or in each pixel in the image display unit 30.

The present embodiment can provide the display device and the color conversion method capable of reducing the power consumption in a low-luminance state with a configuration that performs color conversion to reduce the power consumption in the image display unit.

APPLICATION EXAMPLES

The following describes application examples of the display device 100 according to the first to the third embodiments with reference to FIGS. 23 to 31. The first to the third embodiments are hereinafter referred to as the present embodiment. FIGS. 23 to 31 are views of examples of an electronic apparatus to which the display device according to the present embodiment is applied. The display device 100 according to the present embodiment is applicable to electronic apparatuses of all fields, such as portable electronic apparatuses including mobile phones and smartphones, television apparatuses, digital cameras, notebook personal computers, video cameras, and meters provided to a vehicle. In other words, the display device 100 according to the present embodiment is applicable to electronic apparatuses of all fields that display video signals received from the outside or video signals generated inside thereof as an image or video. The electronic apparatus includes a control device that supplies video signals to the display device 100 and controls the operation of the display device 100.

First Application Example

Figure 23:
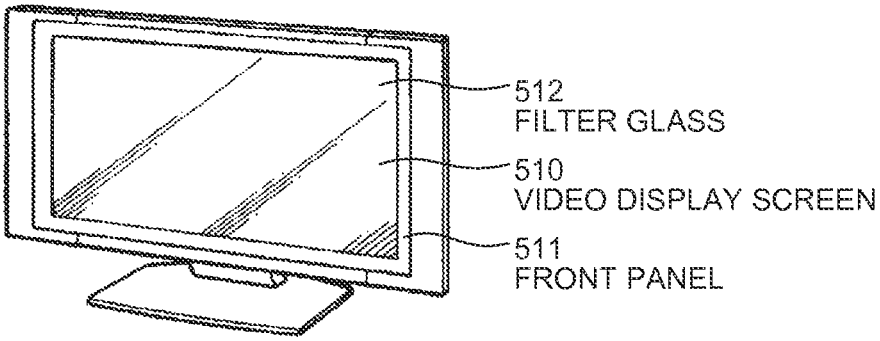
FIG. 23 is a schematic view of an example of an electronic apparatus to which the display device according to any one of the embodiments is applied.

An electronic apparatus illustrated in FIG. 23 is a television apparatus to which the display device 100 according to the present embodiment is applied. The television apparatus has a video display screen 510 including a front panel 511 and a filter glass 512, for example. The video display screen 510 corresponds to the display device 100 according to the present embodiment.

Second Application Example

Figure 24:
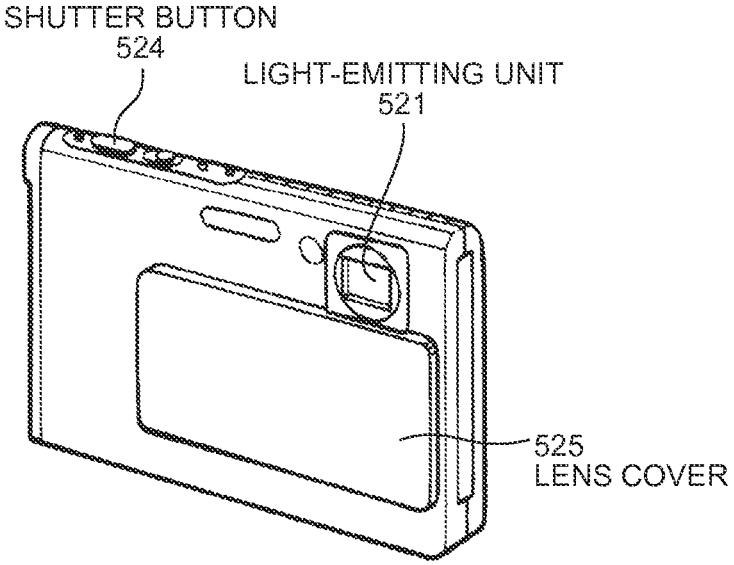
FIG. 24 is a schematic view of an example of an electronic apparatus to which the display device according to any one of the embodiments is applied.
Figure 25:
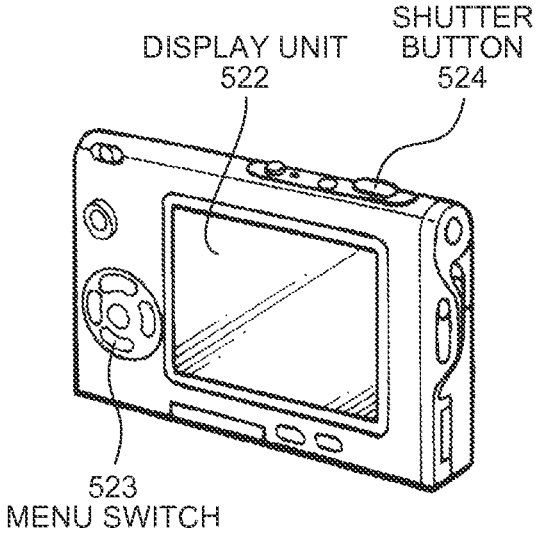
FIG. 25 is a schematic view of an example of an electronic apparatus to which the display device according to any one of the embodiments is applied.

An electronic apparatus illustrated in FIGS. 24 and 25 is a digital camera to which the display device 100 according to the present embodiment is applied. The digital camera includes a light-emitting unit 521 for flash, a display unit 522, a menu switch 523, and a shutter button 524, for example. The display unit 522 corresponds to the display device 100 according to the present embodiment. As illustrated in FIG. 24, the digital camera includes a lens cover 525. Sliding the lens cover 525 exposes a photographing lens. The digital camera captures light entering through the photographing lens, thereby taking a digital picture.

Third Application Example

Figure 26:
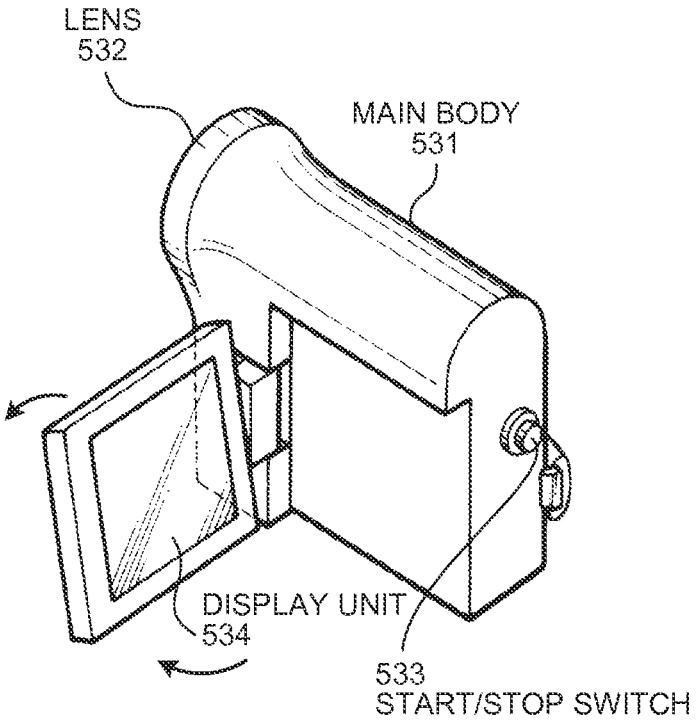
FIG. 26 is a schematic view of an example of an electronic apparatus to which the display device according to any one of the present embodiments is applied.

An electronic apparatus illustrated in FIG. 26 is a video camera to which the display device 100 according to the present embodiment is applied. The video camera includes a main body 531, a lens 532 provided to the front side surface of the main body 531 and used for photographing a subject, a start/stop switch 533 used in photographing, and a display unit 534, for example. The display unit 534 corresponds to the display device 100 according to the present embodiment.

Fourth Application Example

Figure 27:
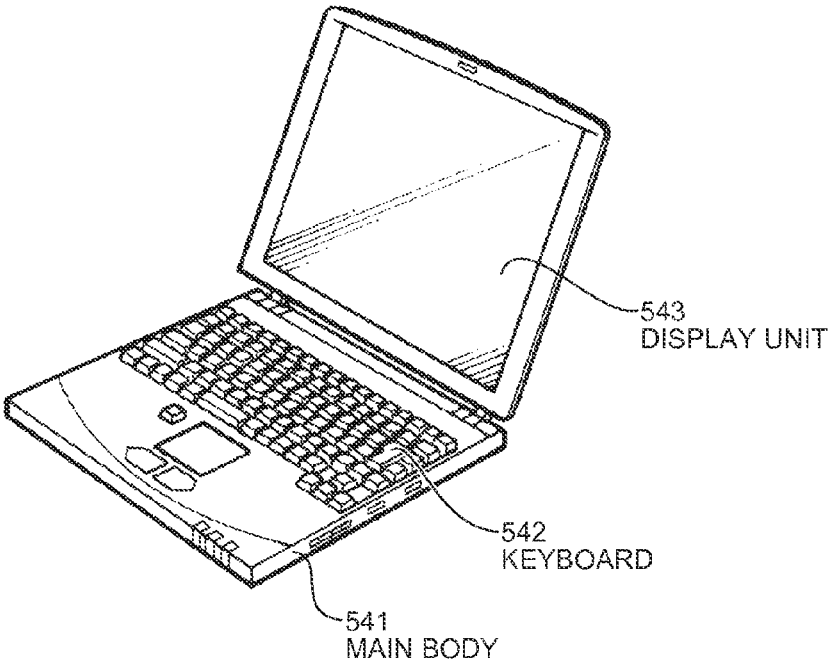
FIG. 27 is a schematic view of an example of an electronic apparatus to which the display device according to any one of the embodiments is applied.

An electronic apparatus illustrated in FIG. 27 is a notebook personal computer to which the display device 100 according to the present embodiment is applied. The notebook personal computer includes a main body 541, a keyboard 542 used for input of characters and the like, and a display unit 543 that displays an image, for example. The display unit 543 corresponds to the display device 100 according to the present embodiment.

Fifth Application Example

Figure 28:
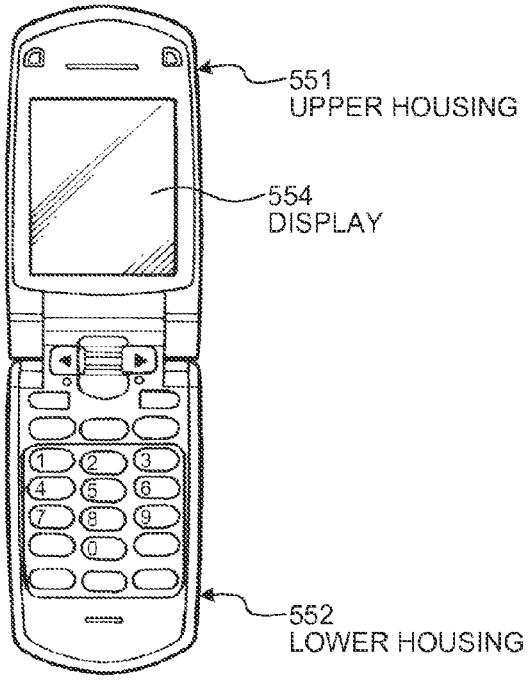
FIG. 28 is a schematic view of an example of an electronic apparatus to which the display device according to any one of the embodiments is applied.
Figure 29:
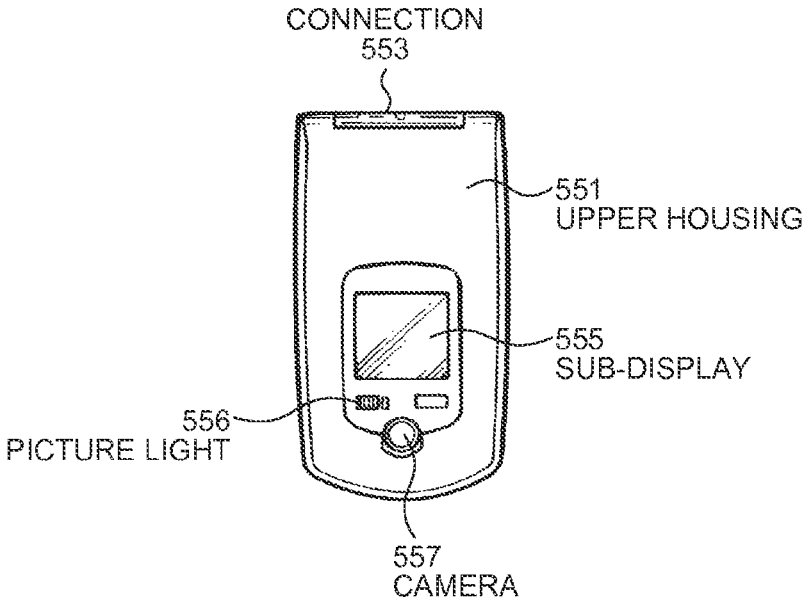
FIG. 29 is a schematic view of an example of an electronic apparatus to which the display device according to any one of the embodiments is applied.

An electronic apparatus illustrated in FIGS. 28 and 29 is a mobile phone to which the display device 100 is applied. FIG. 28 is a front view of the mobile phone in an unfolded state. FIG. 29 is a front view of the mobile phone in a folded state. The mobile phone includes an upper housing 551 and a lower housing 552 connected by a connection (hinge) 553, for example. The mobile phone further includes a display 554, a sub-display 555, a picture light 556, and a camera 557. The display 554 is provided with the display device 100. The display 554 of the mobile phone may also have a function to detect a touch besides a function to display an image.

Sixth Application Example

Figure 30:
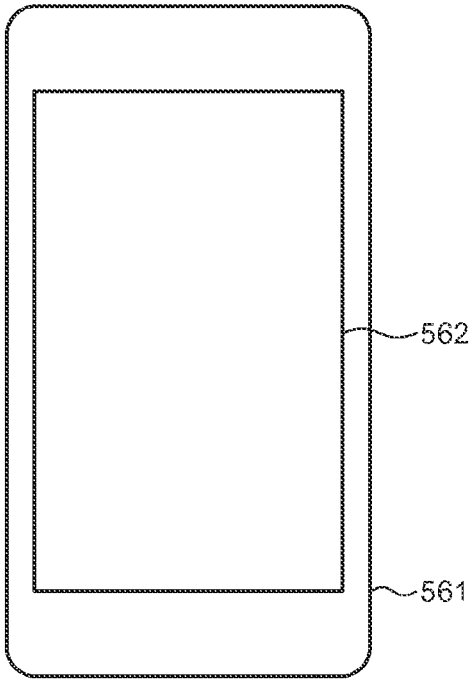
FIG. 30 is a schematic view of an example of an electronic apparatus to which the display device according to any one of the embodiments is applied.

An electronic apparatus illustrated in FIG. 30 operates as a mobile computer, a multifunctional mobile phone, a mobile computer capable of making a voice call, or a mobile computer capable of performing communications. The electronic apparatus is a portable information terminal, which may be called a smartphone or a tablet terminal. The portable information terminal includes a display unit 562 on the surface of a housing 561, for example. The display unit 562 corresponds to the display device 100 according to the present embodiment.

Seventh Application Example

Figure 31:
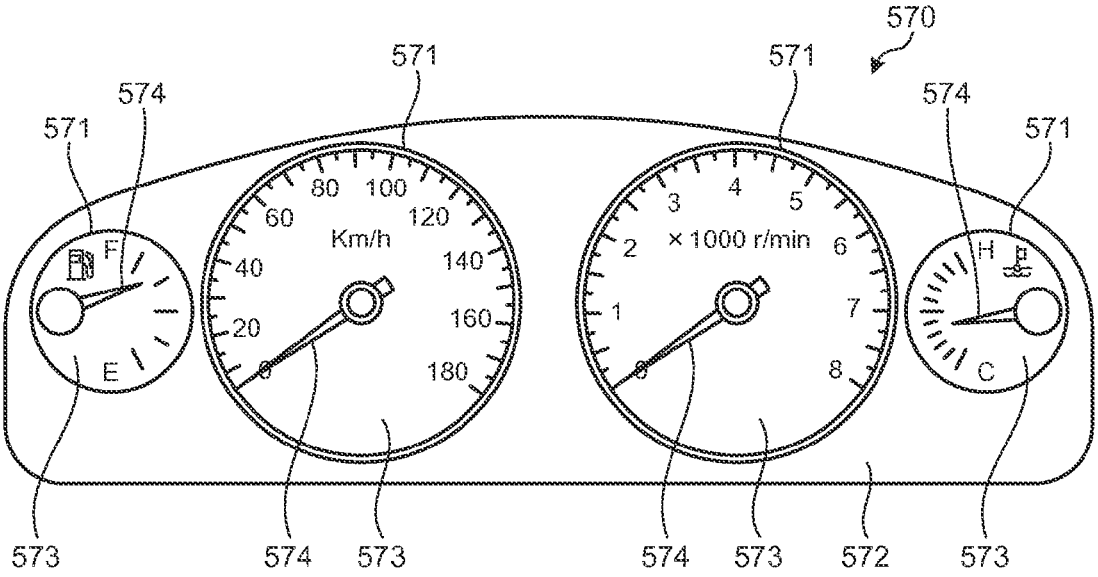
FIG. 31 is a schematic view of an example of an electronic apparatus to which the display device according to any one of the embodiments is applied.

FIG. 31 is a schematic of a configuration of a meter unit according to the present embodiment. An electronic apparatus illustrated in FIG. 31 is a meter unit mounted on a vehicle. A meter unit (electronic apparatus) 570 illustrated in FIG. 31 includes a plurality of display devices 100 according to the present embodiment, such as a fuel gauge, a water temperature gauge, a speed meter, and a tachometer, as display devices 571. The display devices 571 are covered with a single exterior panel 572.

The display devices 571 illustrated in FIG. 31 each include a combination of a panel 573 serving as a display unit and a movement mechanism serving as an analog display unit. The movement mechanism includes a motor serving as a drive unit and an indicator 574 rotated by the motor. As illustrated in FIG. 31, the display devices 571 can display a gauge, a warning, and the like on the display surface of the panel 573. The display devices 571 can rotate the indicator 574 of the movement mechanism on the display surface of the panel 573.

While the display devices 571 are provided to the single exterior panel 572 in FIG. 31, the configuration is not limited thereto. One display device 571 may be provided to the area covered with the exterior panel 572 and display a fuel gauge, a water temperature gauge, a speed meter, and a tachometer, for example.

The contents described above are not intended to limit the present disclosure. Components according to the present disclosure include components easily conceivable by those skilled in the art, components substantially identical therewith, and what is called equivalents. The components described above may be appropriately combined. Various omissions, substitutions, and changes of the components may be made without departing from the spirit of the invention.

The present disclosure includes the following aspects.

(1) A display device comprising:

an image display unit in which pixels are arranged in a matrix, each of the pixels including a plurality of sub-pixels; and a color converting unit that performs color conversion to reduce power consumption in the image display unit, wherein the color converting unit does not perform the color conversion when total power consumption obtained by adding up the power consumption in the image display unit and power consumption in the color converting unit in a case where the color conversion is performed exceeds the power consumption in the image display unit in a case where the color conversion is not performed.

(2) The display device according to (1), wherein the color conversion is processing to increase an amount of reduction in the power consumption in the image display unit with an increase in display luminance of an image displayed by the image display unit, and the color converting unit is provided with a first luminance setting threshold corresponding to display luminance at which the total power consumption obtained by adding up the power consumption in the image display unit and the power consumption in the color converting unit in a case where the color conversion is performed in an entire display luminance range of the image display unit intersects with the power consumption in the image display unit in a case where the color conversion is not performed, and the color converting unit does not perform the color conversion when a predetermined luminance setting value falls within a first luminance setting range that is a range smaller than the first luminance setting threshold.

(3) The display device according to (2), wherein the color converting unit is provided with a second luminance setting threshold larger than the first luminance setting threshold, and the color converting unit changes a color conversion level indicating a degree of a change in display quality caused by the color conversion based on the luminance setting value when the luminance setting value falls within a second luminance setting range that is a range equal to or larger than the first luminance setting threshold and equal to or smaller than the second luminance setting threshold.

(4) The display device according to (3), wherein the color converting unit raises the color conversion level with an increase in the luminance setting value in the second luminance setting range.

(5) The display device according to (2), wherein the color converting unit is provided with a second luminance setting threshold larger than the first luminance setting threshold, and the color converting unit performs the color conversion in a time-division manner based on the luminance setting value within a range where a change in display quality caused by the color conversion is allowed when the luminance setting value falls within a second luminance setting range that is a range equal to or larger than the first luminance setting threshold and equal to or smaller than the second luminance setting threshold.

(6) The display device according to (5), wherein, when performing the color conversion in the time-division manner in the second luminance setting range, the color converting unit performs the color conversion in units of a frame.

(7) The display device according to (6), wherein the color converting unit performs the color conversion at a frame rate that prevents the total power consumption obtained by adding up the power consumption in the image display unit and the power consumption in the color converting unit from exceeding the power consumption in the image display unit in a case where the color conversion is not performed in the second luminance setting range.

(8) The display device according to (6) or (7), wherein the color converting unit shifts a timing of the color conversion for each horizontal line or for each pixel in the image display unit in the second luminance setting range.

(9) A color conversion method for an input signal supplied to a drive circuit of an image display unit in which pixels are arranged in a matrix, each of the pixels including a plurality of sub-pixels, the color conversion method comprising, not performing color conversion to reduce power consumption in the image display unit when total power consumption obtained by adding up the power consumption in the image display unit and power consumption caused by the color conversion in a case where the color conversion is performed exceeds the power consumption in the image display unit in a case where the color conversion is not performed.

(10) An electronic apparatus comprising the display device according to any one of (1) to (8) and a control device that supplies a video signal and controls an operation of the display device.

What is claimed is:

1. A display device comprising:

an image display unit in which pixels are arranged in a matrix, each of the pixels including a plurality of sub-pixels; and a color converting unit that performs color conversion to reduce power consumption in the image display unit, wherein the color converting unit does not perform the color conversion when total power consumption obtained by adding up the power consumption in the image display unit and power consumption in the color converting unit in a case where the color conversion is performed exceeds the power consumption in the image display unit in a case where the color conversion is not performed.

2. The display device according to claim 1, wherein the color conversion is processing to increase an amount of reduction in the power consumption in the image display unit with an increase in display luminance of an image displayed by the image display unit, and the color converting unit is provided with a first luminance setting threshold corresponding to display luminance at which the total power consumption obtained by adding up the power consumption in the image display unit and the power consumption in the color converting unit in a case where the color conversion is performed in an entire display luminance range of the image display unit intersects with the power consumption in the image display unit in a case where the color conversion is not performed, and the color converting unit does not perform the color conversion when a predetermined luminance setting value falls within a first luminance setting range that is a range smaller than the first luminance setting threshold.

3. The display device according to claim 2, wherein the color converting unit is provided with a second luminance setting threshold larger than the first luminance setting threshold, and the color converting unit changes a color conversion level indicating a degree of a change in display quality caused by the color conversion based on the luminance setting value when the luminance setting value falls within a second luminance setting range that is a range equal to or larger than the first luminance setting threshold and equal to or smaller than the second luminance setting threshold.

4. The display device according to claim 3, wherein the color converting unit raises the color conversion level with an increase in the luminance setting value in the second luminance setting range.

5. The display device according to claim 2, wherein the color converting unit is provided with a second luminance setting threshold larger than the first luminance setting threshold, and the color converting unit performs the color conversion in a time-division manner based on the luminance setting value within a range where a change in display quality caused by the color conversion is allowed when the luminance setting value falls within a second luminance setting range that is a range equal to or larger than the first luminance setting threshold and equal to or smaller than the second luminance setting threshold.

6. The display device according to claim 5, wherein, when performing the color conversion in the time-division manner in the second luminance setting range, the color converting unit performs the color conversion in units of a frame.

7. The display device according to claim 6, wherein the color converting unit performs the color conversion at a frame rate that prevents the total power consumption obtained by adding up the power consumption in the image display unit and the power consumption in the color converting unit from exceeding the power consumption in the image display unit in a case where the color conversion is not performed in the second luminance setting range.

8. The display device according to claim 6, wherein the color converting unit shifts a timing of the color conversion for each horizontal line or for each pixel in the image display unit in the second luminance setting range.

9. A color conversion method for an input signal supplied to a drive circuit of an image display unit in which pixels are arranged in a matrix, each of the pixels including a plurality of sub-pixels the color conversion method comprising, not performing color conversion to reduce power consumption in the image display unit when total power consumption obtained by adding up the power consumption in the image display unit and power consumption caused by the color conversion in a case where the color conversion is performed exceeds the power consumption in the image display unit in a case where the color conversion is not performed.

* * * * *